US010261458B2

(12) United States Patent
Kawai

(10) Patent No.: US 10,261,458 B2
(45) Date of Patent: Apr. 16, 2019

(54) IMAGE FORMING APPARATUS TO JUDGE LIFETIME END OF EXPENDABLE ITEM

(71) Applicant: KONICA MINOLTA, INC., Tokyo (JP)

(72) Inventor: Atsushi Kawai, Toyokawashi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/925,115

(22) Filed: Mar. 19, 2018

(65) Prior Publication Data

US 2018/0275583 A1 Sep. 27, 2018

(30) Foreign Application Priority Data

Mar. 21, 2017 (JP) ..... 2017-053934

(51) Int. Cl.
*G03G 15/00* (2006.01)

(52) U.S. Cl.
CPC ... *G03G 15/553* (2013.01); *G03G 2215/0429* (2013.01); *G03G 2221/1663* (2013.01)

(58) Field of Classification Search
CPC ..... G03G 15/553; G03G 2221/1663; G03G 15/55; G03G 15/556
See application file for complete search history.

(56) References Cited

U.S. PATENT DOCUMENTS

2008/0112715 A1* 5/2008 Shiroki ..... G03G 15/553 399/27
2008/0212984 A1* 9/2008 Sasaki ..... G03G 15/553 399/24

FOREIGN PATENT DOCUMENTS

| | | | |
|---|---|---|---|
| JP | 2005195900 | A | 7/2005 |
| JP | 2008158115 | A | 7/2008 |
| JP | 2016057420 | A | 4/2016 |
| JP | 2016071043 | A | 5/2016 |

* cited by examiner

*Primary Examiner* — Sandra Brase
(74) *Attorney, Agent, or Firm* — Lucas & Mercanti, LLP

(57) ABSTRACT

An image forming apparatus comprises an expendable item having a specific function, installed replaceably with respect to a main body of the image forming apparatus, wherein there are several types of expendable items, and an engine control unit. The engine control unit judges end of lifetime of the expendable item by using one of a plurality of lifetime judgment methods. The engine control unit selects a lifetime judgment method used in the judgment, according to a type of the expendable item. It makes possible to provide an image forming apparatus capable of appropriately determining the reaching of the lifetime end of expendable items.

19 Claims, 24 Drawing Sheets

(a)

| TYPE OF ITEM | DEFINITION | PERFORMANCE |
| --- | --- | --- |
| NEW GENUINE PRODUCT | UNUSED EXPENDABLE ITEM APPROVED BY MANUFACTURER OF IMAGE FORMING APPARATUS | HIGH POSSIBILITY THAT QUALITY CAN BE MAINTAINED, EVEN AFTER COUNTER VALUE REACHES END OF LIFE |

FIG. 5

122

| ADDRESS | TYPE OF STORED DATA | MEMORY ATTRIBUTE |
|---|---|---|
| 00h ~ 1Fh | TYPE IDENTIFICATION<br>COLOR IDENTIFICATION<br>FILLING AMOUNT IDENTIFICATION | READ ONLY<br>(ROM AREA) |
| 20h ~ 2Fh | PRINTING OPERATION STATE | READ/WRITE POSSIBLE<br>(R/W AREA) |
| 30h ~ 3Fh | REPRODUCTION INFORMATION | WRITE POSSIBLE ONLY ONCE<br>(OTP AREA) |

(a)

| TYPE OF ITEM | DEFINITION | PERFORMANCE |
| --- | --- | --- |
| REUSED ITEM | REUSABLE EXPENDABLE ITEM CONSUMED PART EXCHANGEABLE APPROVED BY MANUFACTURER OF IMAGE FORMING APPARATUS | HIGH POSSIBILITY THAT QUALITY CAN BE MAINTAINED, BEFORE COUNTER VALUE REACHES END OF LIFE, BUT LOW POSSIBILITY AFTER THAT |

FIG. 11

| PAIR OF ITEMS | ITEM UNIT | TYPE OF ITEM | JUDGMENT METHOD |
|---|---|---|---|
| CASE 1 | DEVELOP UNIT | GENUINE | EXTENDED METHOD |
| | PHOTOSENSITIVE UNIT | GENUINE | EXTENDED METHOD |
| CASE 2 | DEVELOP UNIT | NON-GENUINE | CORRESPONDING METHOD |
| | PHOTOSENSITIVE UNIT | GENUINE | METHOD ONLY BY NUMBER OF TIMES |
| CASE 3 | DEVELOP UNIT | GENUINE | METHOD ONLY BY NUMBER OF TIMES |
| | PHOTOSENSITIVE UNIT | NON-GENUINE | CORRESPONDING METHOD |
| CASE 4 | DEVELOP UNIT | NON-GENUINE | CORRESPONDING METHOD |
| | PHOTOSENSITIVE UNIT | NON-GENUINE | CORRESPONDING METHOD |

(a)

| TYPE OF ITEM | DEFINITION | PERFORMANCE |
| --- | --- | --- |
| SECONDHAND ITEM | EXPENDABLE ITEM NOT NEW, APPROVED BY MANUFACTURER OF IMAGE FORMING APPARATUS THE LIFE HAS NOT RUN OUT | POSSIBILITY THAT QUALITY CAN DETERIORATES, BEFORE COUNTER VALUE REACHES END OF LIFE, SINCE LOW RELIABILITY OF COUNTER |

FIG. 15

| TYPE OF METHOD | STORED DATA IN MEMORY | | TYPE OF ITEM | JUDGMENT METHOD |
|---|---|---|---|---|
| | bit1 | bit2 | | |
| FIRST METHOD | 1 | 0 | NEW GENUINE PRODUCT THE LIFE IS EXTENDABLE | EXTENDED METHOD |
| SECOND METHOD | 0 | 1 | NEW GENUINE PRODUCT IN EARLY DISTRIBUTION STAGE | METHOD ONLY BY NUMBER OF TIMES |
| THIRD METHOD | 0 | 0 | NOT NEW GENUINE PRODUCT | PARALLEL METHOD |

FIG. 21

| | Y | | M | | C | | K | |
|---|---|---|---|---|---|---|---|---|
| DEVELOP BIAS | 300krot UNDER | 300krot OR MORE | 300krot UNDER | 300krot OR MORE | 300krot UNDER | 300krot OR MORE | 300krot UNDER | 300krot OR MORE |
| UPPER LIMIT | 500 | 400 | 460 | 400 | 460 | 400 | 520 | 430 |
| LOWER LIMIT | 390 | 260 | 390 | 270 | 340 | 250 | 410 | 330 |

IMAGE FORMING APPARATUS TO JUDGE LIFETIME END OF EXPENDABLE ITEM

The entire disclosure of Japanese patent application No. 2017-53934 filed on Mar. 21, 2017, is incorporated herein by reference in its entirety.

BACKGROUND

Technological Field

The present invention relates to an image forming apparatus and a control program for the image forming apparatus. More specifically, the present invention relates to an image forming apparatus and a control program for an image forming apparatus provided with expendable items having a plurality of types. The expendable item is exchangeably installed in the main body of the image forming apparatus and has a specific function.

Description of the Related Art

As an electrophotographic image forming apparatus, there is an MFP (Multi Function Peripheral) having a scanner function, a facsimile function, a copying function, a function as a printer, a data communication function, and a server function. As an electrophotographic image forming apparatus, there are a facsimile apparatus, a copying machine, a printer, and the like.

Generally, an image forming apparatus forms a toner image by developing an electrostatic latent image formed on a photosensitive member with a developing device. The image forming apparatus transfers the toner image to the sheet, and then fixes the toner image on the sheet by the fixing device. As a result, an image is formed on the sheet. Some image forming apparatuses form a toner image by developing the electrostatic latent image on the surface of the photosensitive member, using a developing device. The image forming apparatus transfers the toner image to an intermediate transfer belt by using a primary transfer roller. The image forming apparatus secondarily transfers the toner image on the intermediate transfer belt to the paper using a secondary transfer roller. In this case, the photosensitive member and the intermediate transfer belt serve as image carriers. Toner which is not used for development in the developing device or toner which is not transferred but remains on the photosensitive member or on the intermediate transfer belt is collected in the recovery container as waste toner.

Generally, a development unit (DV) and a photosensitive member unit (DR) are mounted as independent consumable units in a conventional MFP of medium and high speed machine. The MFP determines the degree of deterioration of the consumable unit, based on the value of the counter indicating the number of sheets (the number of printed sheets) printed using the consumable unit. When the value of the counter exceeds the threshold value set in the consumable unit, the MFP judges that the lifetime end of the consumable unit has been reached. The MFP displays the reaching of the lifetime end of the consumable unit on the display unit of the MFP. As a result, the MFP prompts the user to replace the consumable unit.

However, according to the lifetime judgment method by the counter described above, the minimum number of prints that the manufacturer can guarantee the image quality is set as the threshold value. For this reason, in spite of the fact that the expendable item is still usable, it is often determined that the lifetime end has been reached. As an example, the threshold value of the developing unit is often set to a value that does not cause image smearing due to fog toner or the like even when the charging ability of the photosensitive member is lowered as the lifetime end of the photosensitive member unit approaches. Therefore, the actual lifetime end of the developing unit depends not only on the state of the developing material of the developing unit itself but also on the state of the photosensitive member unit. In the past, however, it was judged that the lifetime end has reached only by the counter value of the developing unit. For this reason, when the condition of the photosensitive member unit is satisfactory, the developing unit is replaced even though it is still usable.

Also, there are various types of expendable items (for example, photosensitive member unit) that exhibit the same function. Specifically, there are expendable items that are new and genuine products, and expendable items that are different from genuine new ones. An expendable item of a type different from a new genuine product is, for example, an imitation product (non-genuine product), a reused item (a recycled item of a genuine product), a reset item (thing with illegally reset counter of genuine products), a secondhand item (not new but genuine product before lifetime end), or the like.

Generally, the performance of expendable items of a different type from a new genuine product is inferior to the performance of expendable items which are new and genuine. For this reason, when an expendable item of a different type from the new genuine product is used, according to the lifetime judgment method based on the value of the counter described above, the performance of the expendable item deteriorates before the value of the counter exceeds the threshold set in the consumable unit, which may adversely affect the image.

Therefore, in place of the lifetime judgment method based on the above-mentioned counter value, in order to more accurately determine the reaching of the lifetime end of the expendable item, a method of determining the reaching of the lifetime end of the expendable item based on the actually measured value of the expendable item (for example, physical property values of the expendable item, density of images formed using the expendable item, etc.) at a predetermined timing (a lifetime judgment method based on actually measured value) is also conceivable.

A method of determining the lifetime of expendable items in a conventional image forming apparatus is disclosed in, for example, Documents 1 to 4 below. Document 1 below discloses an image forming apparatus that includes an image bearing member that carries an image and a charging unit that charges the image bearing member, and each of the image bearing member and the charging unit can be replaced. This image forming apparatus is provided with a voltage applying unit that applies a voltage to the charging unit, a current detecting unit that detects a current flowing to the image bearing member when the voltage applying unit applies the current, and a control means for judging the replacement of the image bearing member or the charging unit, based on the detected current by the current detecting unit.

Document 2 below discloses an image forming apparatus that forms an image by transferring a toner image formed on a photosensitive drum. This image forming apparatus has a life counter for calculating the life of the photosensitive drum and detecting the life of the photosensitive drum. The image forming apparatus includes an abutting member detecting means for detecting whether or not an abutting member abutting against the photosensitive drum is attached. The image forming apparatus changes the calculation method of the life of the photosensitive drum based on the detection result of the abutting member detecting means.

Document 3 below discloses an image forming apparatus including a developing device detachably attached to a main frame of the image forming apparatus. In this image forming apparatus, an IC (Integrated Circuit) chip is attached to the toner case of the developing device, and an identification code for identifying that the developing device is a genuine product is stored in the IC chip. The control unit of the image forming apparatus reads the stored identification code to determine whether it is a genuine product. When it is judged that the product is a genuine product, the control unit updates the use record information such as the data of the cumulative number of sheets of the image-recorded paper. When it is judged that it is not a genuine product, such update processing is not performed.

Document 4 below discloses an image forming apparatus that sets a trial period when recognizing that a non-genuine process cartridge is installed. Even if the process cartridge is not a genuine product, the image forming apparatus can be used with a limited period.

Document(s)

[Document(s) Related to Patent(s)]

[Document 1] Japanese Unexamined Patent Publication No. 2016-71043

[Document 2] Japanese Unexamined Patent Publication No. 2016-57420

[Document 3] Japanese Unexamined Patent Publication No. 2008-158115

[Document 4] Japanese Unexamined Patent Publication No. 2005-195900

However, if it is tried to judge the lifetime end of the expendable item only by the lifetime judgment method based on the actually measured value, it takes time to measure the actually measured value of the expendable item, and causes a delay in the operation of the image forming apparatus.

SUMMARY

An object of the present invention is to provide an image forming apparatus and a control program for an image forming apparatus capable of appropriately determining the reaching of lifetime end of an expendable item.

To achieve at least one of the abovementioned objects, according to an aspect of the present invention, an image forming apparatus reflecting one aspect of the present invention comprises an expendable item having a specific function, installed replaceably with respect to a main body of the image forming apparatus, wherein there are several types of expendable items, and a hardware processor, wherein the hardware processor judges end of lifetime of the expendable item by using one of a plurality of lifetime judgment methods, and the hardware processor selects a lifetime judgment method used in the judgment, according to a type of the expendable item.

According to another aspect of the invention, a non-transitory computer-readable recording medium storing a controlling program for an image forming apparatus, wherein the image forming apparatus includes an expendable item having a specific function, installed replaceably with respect to a main body of the image forming apparatus, wherein there are several types of expendable items, and the program causing a computer to: judge end of lifetime of the expendable item by using one of a plurality of lifetime judgment methods, and select a lifetime judgment method used in the judgment, according to a type of the expendable item.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 5 is a diagram showing address mapping of the nonvolatile memory 122 in the first embodiment of the present invention.

FIG. 11 is a diagram showing a relationship between a set of a developing unit and a consumable unit in a third embodiment of the present invention and a lifetime judgment method to be adopted.

FIG. 15 is a diagram showing a relationship between information stored in the nonvolatile memory 122 of the expendable item and a lifetime judgment method, according to the sixth embodiment of the present invention.

FIG. 21 is a table showing another example of the allowable range of the developing bias in the seventh embodiment of the present invention, in the case of detecting the reaching of lifetime end, using the detection method based on the actually measured value of the developing unit 31.

DETAILED DESCRIPTION OF EMBODIMENTS

Hereinafter, one or more embodiments of the present invention will be described with reference to the drawings. However, the scope of the invention is not limited to the disclosed embodiments.

In the present embodiment, the case where the image forming apparatus is an MFP will be described. The image forming apparatus may be a MFP, a facsimile machine, a copying machine, a printer, or the like.

First Embodiment

First, the configuration of the image forming apparatus according to the present embodiment will be described.

Figure 1:
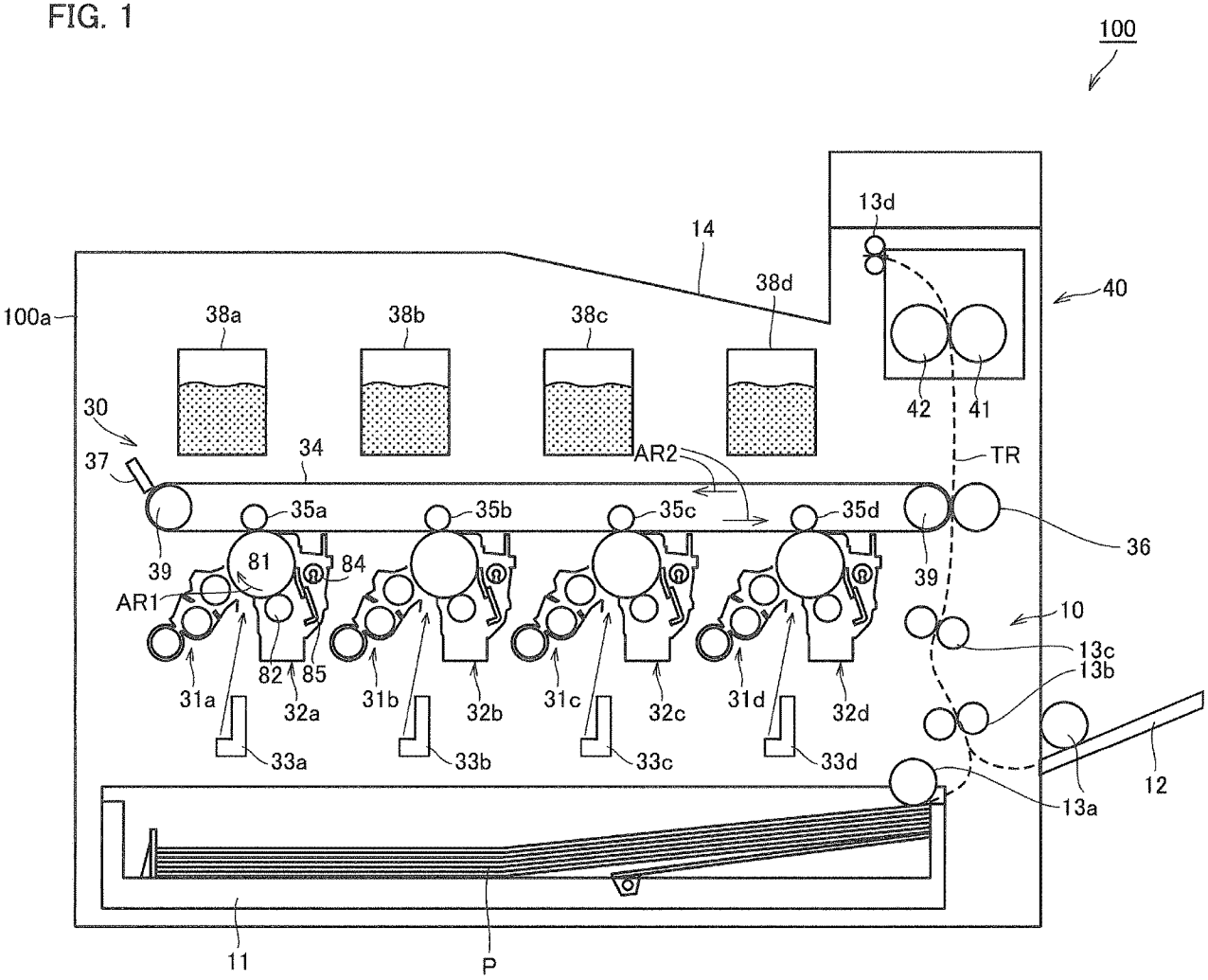
FIG. 1 is a cross-sectional view showing a configuration of an image forming apparatus 100, according to a first embodiment of the present invention.

FIG. 1 is a cross-sectional view showing a configuration of an image forming apparatus 100 according to a first embodiment of the present invention.

Referring to FIG. 1, image forming apparatus 100 in the present embodiment is an MFP, and mainly includes sheet conveying section 10, toner image forming section 30, and fixing apparatus 40.

The sheet conveying section 10 includes a sheet feed tray 11, a manual feed tray 12, a sheet feed roller 13*a*, conveyance rollers 13*b* and 13*c*, a sheet discharge roller 13*d*, and a sheet discharge tray 14. The paper feed tray 11 is provided at the bottom of the image forming apparatus main body 100*a* and accommodates the paper P for forming images. A plurality of paper feed trays 11 may be used. The manual feed tray 12 is provided on the side surface of the image forming apparatus main body 100*a* and is used for arranging manual feed paper. The paper feed rollers 13*a* are provided between the paper feed tray 11 and the manual insertion tray 12, and the conveying path TR. Each of the conveyance rollers 13*b* and 13*c* is provided along the conveying path TR. The discharge roller 13*d* is provided at the most downstream portion of the conveying path TR. The paper discharge tray 14 is provided at the top of the image forming apparatus main body 100*a*.

The toner image forming unit 30 synthesizes images of four colors of Y (yellow), M (magenta), C (cyan), and K (black) in a so-called tandem system, and transfers the toner image to the paper. The toner image forming unit 30 includes developing units 31*a*, 31*b*, 31*c*, and 31*d* (examples of developing devices) of Y, M, C, and K colors, photosensitive member units 32*a*, 32*b*, 32*c*, and 32*d* of Y, M, C, and K colors, exposure devices 33*a*, 33*b*, 33*c*, and 33*d* of Y, M, C, and K colors, an intermediate transfer belt 34, primary transfer rollers 35*a*, 35*b*, 35*c*, and 35*d*, a secondary transfer roller 36, a cleaning device 37, YMCK toner bottles 38*a*, 38*b*, 38*c*, and 38*d* of the respective colors and the rotation roller 39 etc.

In the present specification, the developing units 31*a*, 31*b*, 31*c*, and 31*d* may be collectively referred to as a developing unit 31. The photosensitive member units 32*a*, 32*b*, 32*c*, and 32*d* may be collectively referred to as photosensitive member unit 32. The exposure devices 33*a*, 33*b*, 33*c*, 33*d* may be collectively referred to as an exposure device 33. Further, each of the developing units 31*a*, 31*b*, 31*c*, and 31*d*, and each of the photosensitive member units 32*a*, 32*b*, 32*c*, and 32*d* is a replaceable expendable item having a specific function with respect to the image forming apparatus main body 100*a*. These are expendable items in which there are multiple types in the market etc. Thereafter, the developing units 31*a*, 31*b*, 31*c*, and 31*d*, and the photosensitive member units 32*a*, 32*b*, 32*c*, and 32*d* may be collectively referred to as expendable items.

The developing unit 31 and the photosensitive member unit 32 of each color constitute imaging units of respective colors, and are juxtaposed immediately below the intermediate transfer belt 34. The developing unit 31 is a unit having a function of developing. The photosensitive member unit 32 is a unit having a function of an image bearing member, and further includes a charging device 82, an eraser portion 84, a cleaning blade 85, and the like.

The photosensitive member 81 has photoconductivity and is cylindrical. The photosensitive member 81 is rotationally driven in a direction indicated by an arrow AR1 in FIG. 1. Around the photosensitive member 81, a charging device 82, a developing unit 31 for developing a toner image on the photosensitive member 81, an eraser unit 84, and a cleaning blade 85 are disposed. The charging device 82 charges the photosensitive member 81, and the surface potential of the photosensitive member 81 is set to a predetermined charging potential by the charging device 82. The developing unit 31 develops the electrostatic latent image formed on the photosensitive member 81. The eraser unit 84 neutralizes the photosensitive body 81. The cleaning blade 85 removes the waste toner on the photosensitive member 81.

The exposure device 33 is provided under the developing unit 31 and the photosensitive member unit 32 of each color. The intermediate transfer belt 34 is annular, and is laid across rotating rollers 39. The intermediate transfer belt 34 is rotationally driven in a direction indicated by an arrow AR2 in FIG. 1. Each of the primary transfer rollers 35*a*, 35*b*, 35*c*, and 35*d* faces each of the photosensitive members 81 of the photosensitive member units 32 of the respective colors, with the intermediate transfer belt 34 interposed therebetween. The secondary transfer roller 36 is in contact with the intermediate transfer belt 34 in the conveying path TR. The interval between the secondary transfer roller 36 and the intermediate transfer belt 34 can be adjusted by a pressure contacting and separating mechanism (not shown). The cleaning device 37 is provided in the vicinity of the intermediate transfer belt 34.

The fixing device 40 includes a heating roller 41 and a pressure roller 42. The fixing device 40 fixes the toner image on the sheet by conveying it along the conveying path TR, while gripping the sheet bearing the toner image by the nip portion between the heating roller 41 and the pressure roller 42.

The image forming apparatus 100 receives a print request or a copy request of the document image read by the scanner unit 114. Then, the sheet conveying section 10 feeds the sheet P accommodated in the sheet feed tray 11 or the manually fed sheet placed on the manual feed tray 12 to the conveyance path TR by the sheet feed roller 13*a*. The sheet conveying section 10 transports the sheet along the conveying path TR by conveyance rollers 13*b* and 13*c* (timing rollers). The sheet conveying section 10 guides the sheet between the intermediate transfer belt 34 and the secondary transfer roller 36 at a predetermined timing.

The exposure device 33 irradiates an exposing beam based on the image information on which the printing request or the copying request was made, to the photosensitive member 81 charged to a predetermined charging potential by the charging device 82. The surface potential of the portion of the surface of the photosensitive member 81 irradiated with the exposing beam decreases to a predetermined level due to the photoconductivity of the photosensitive member 81. As the surface potential of the surface of the photosensitive member 81 changes, an electrostatic latent image is formed on the surface of the photosensitive member 81 exposed by the exposure device 33. The developing unit 31 develops the electrostatic latent image formed on the surface of the photosensitive member 81.

Each of the primary transfer rollers 35*a*, 35*b*, 35*c*, and 35*d* sequentially transfers the toner image formed on the photosensitive member 81 of each color of photosensitive member unit 32 onto the surface of the intermediate transfer belt 34 (primary transfer). On the surface of the intermediate transfer belt 34, a toner image in which toner images of respective colors are synthesized is formed.

The eraser unit 84 neutralizes the surface of the photosensitive member 81 after the primary transfer. The cleaning blade 85 removes the toner remaining on the photosensitive member 81 without being transferred to the intermediate transfer belt 34.

The rotating roller 39 rotationally drives the intermediate transfer belt 34. As a result, the toner image formed on the surface of the intermediate transfer belt 34 is conveyed to a position facing the secondary transfer roller 36. The secondary transfer roller 36 transfers the toner image formed on the surface of the intermediate transfer belt 34 to a sheet conveyed between the intermediate transfer belt 34 and the secondary transfer roller 36.

The cleaning device 37 removes and collects the toner remaining on the surface of the intermediate transfer belt 34 without being transferred onto the paper.

The sheet to which the toner image was transferred is guided to the fixing device 40. The fixing device 40 fixes the toner image on the sheet. Thereafter, the sheet conveying section 10 discharges the sheet on which the toner image has been fixed onto the sheet discharge tray 14 by the sheet discharge roller 13*d*.

When the amount of toner inside the developing unit 31 decreases due to the image formation, the toner stored in the toner bottles 38*a*, 38*b*, 38*c*, and 38*d* of YMCK having an appropriate color is supplied to the developing unit 31. When the toner inside one of the toner bottles 38*a*, 38*b*, 38*c*, and 38*d* runs out, the user replaces the toner bottle. As a result, the toner is continuously supplied to the image forming apparatus 100.

Figure 2:
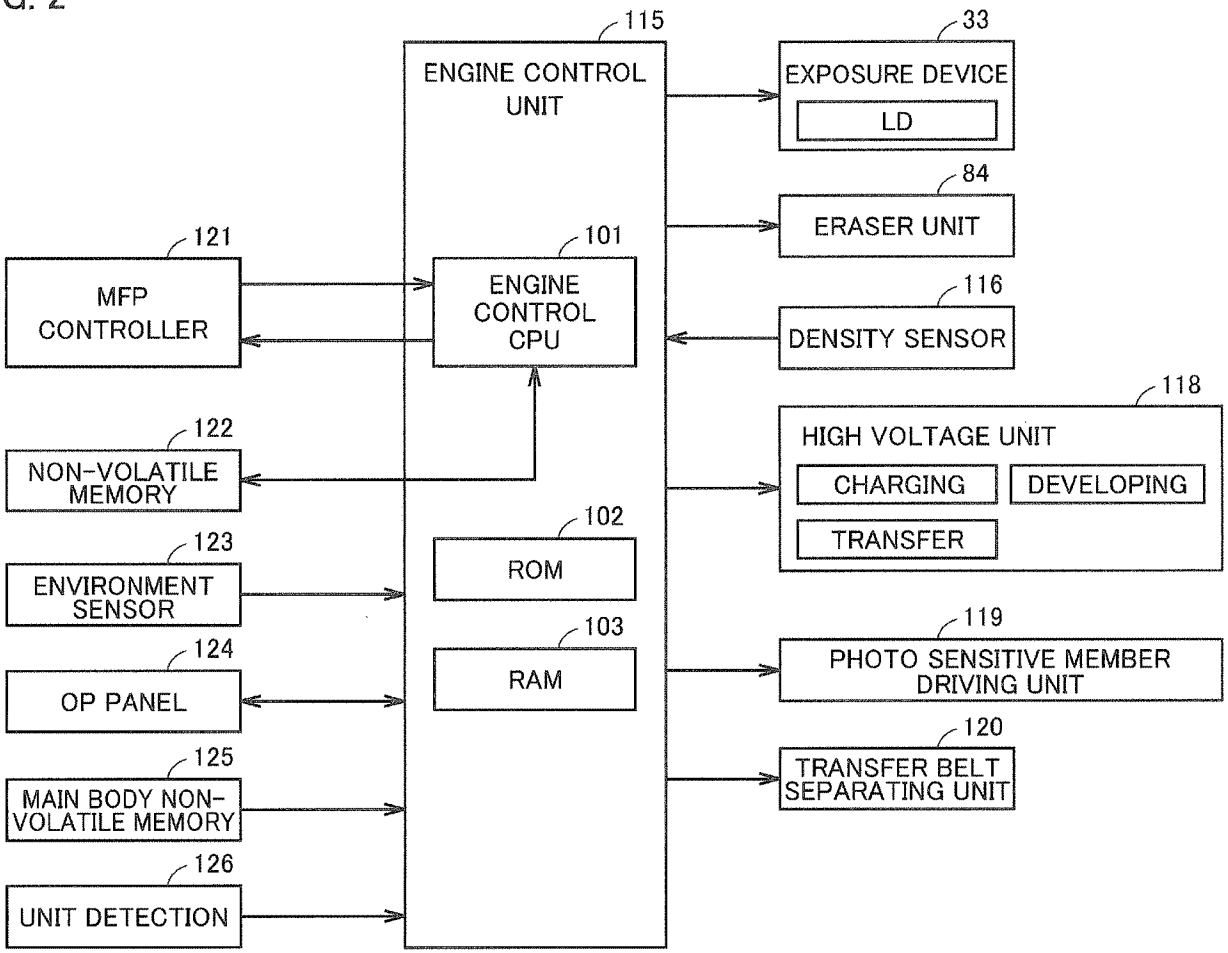
FIG. 2 is a block diagram showing a control configuration of an image forming apparatus 100, according to the first embodiment of the present invention.

FIG. 2 is a block diagram showing a control configuration of the image forming apparatus 100, according to the first embodiment of the present invention.

Referring to FIG. 2, the image forming apparatus 100 further includes an engine control unit 115, a density detection sensor 116, a high voltage unit 118, a photosensitive member driving unit 119, a transfer belt separating unit 120, MFP controller 121, a nonvolatile memory 122 (an example of a nonvolatile storage device), an environmental sensor 123, an operation panel (display operation unit) 124, a main body nonvolatile memory 125, and a unit detection unit 126. An exposure device 33, an eraser unit 84, a concentration detection sensor 116, a high voltage unit 118, a photosensitive member driving unit 119, a transfer belt separating unit 120, an MFP controller 121, a nonvolatile memory 122, an environmental sensor 123, an operation panel 124, a main body nonvolatile memory 125, a unit detection unit 126 are connected to the engine control unit 115.

The engine control unit 115 controls the exposure device 33, the eraser unit 84, the high voltage unit 118, the photosensitive member driving unit 119, the transfer belt separating unit 120, and the like. The engine control unit 115 includes a CPU (Central Processing Unit) (engine control CPU) 101, a ROM (Read Only Memory) 102, a RAM (Random Access Memory) 103, and the like. The CPU 101 performs various processes based on the control program. The ROM 102 stores a control program. The RAM 103 is a work storage area of the CPU 101.

The density detection sensor 116 is provided in the vicinity of the intermediate transfer belt 34 and detects the density of the toner image formed on the intermediate transfer belt 34 by reflected light. The toner image is formed with constant developing conditions (charging potential, developing bias, laser light amount), and the physical property values of the developing unit 31 and the photosensitive member unit 32 are estimated from the density.

The high voltage unit 118 applies bias voltages for charging, developing, and transfer.

The photosensitive member driving unit 119 drives the photosensitive member 81.

The transfer belt separating unit 120 adjusts the interval between the secondary transfer roller 36 and the intermediate transfer belt 34.

The MFP controller 121 communicates with a user interface such as the operation panel 124 and external devices.

The nonvolatile memory 122 is built in each expendable item installed in the image forming apparatus main body 100*a*. The nonvolatile memory 122 stores a manufacturing history of the expendable item and a counter value which is a value indicative of the number of times of operation or operation time of the expendable item. This counter value is updated (increased) by the engine control unit 115 each time the number of times of operation or operation time of the expendable item increases.

The environmental sensor 123 measures the temperature and humidity around the image forming apparatus 100.

The operation panel 124 displays various kinds of information and accepts various operations.

The main body nonvolatile memory 125 is provided in the image forming apparatus main body 100*a*, and stores various pieces of information.

The unit detection unit 126 detects installation of each expendable item in the image forming apparatus main body 100*a*.

Next, the operation of the image forming apparatus 100 according to the present embodiment will be described.

The engine control unit 115 determines the life of expendable items installed in the image forming apparatus 100 by using any one of a plurality of lifetime judgment methods. The engine control unit 115 selects a lifetime judgment method from a plurality of lifetime judgment methods, according to the type of the expendable items installed in the image forming apparatus 100. Each of the plurality of lifetime judgment methods is different at a combination of a detection method by a counter and a detection method based on an actually measured value, which will be described later.

Figure 3:
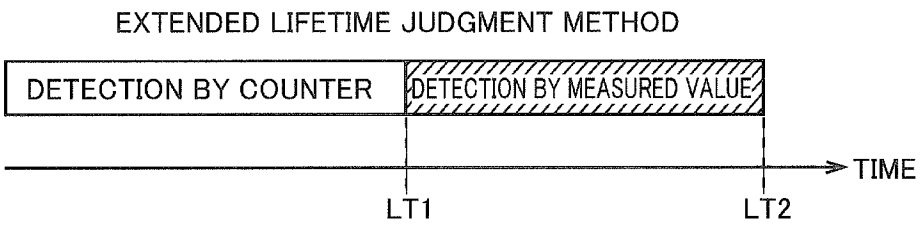
FIG. 3 is a diagram for explaining a lifetime judgment method in the case where the type of the expendable item is a new genuine product, according to the first embodiment of the present invention.
Figure 4:
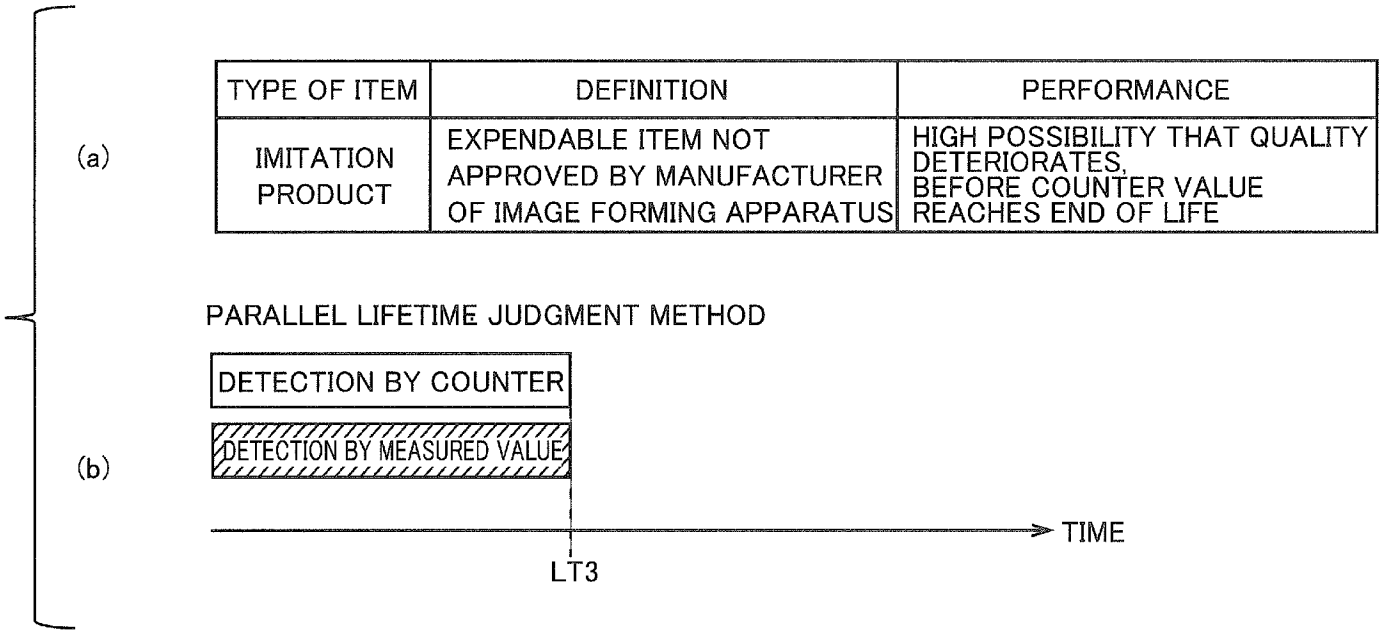
FIG. 4 is a diagram for explaining a lifetime judgment method in the case where the type of the expendable item is an imitation product in the first embodiment of the present invention.

FIG. 3 is a diagram for explaining a lifetime judgment method in the case where the type of the expendable item is a new genuine product, according to the first embodiment of the present invention. FIG. 4 is a diagram for explaining a lifetime judgment method in the case where the type of the expendable item is an imitation product, in the first embodiment of the present invention.

Referring to FIG. 3(*a*), in the present embodiment, the engine control unit 115 detects replacement of an expendable item by the unit detection unit 126. In this case, the engine control unit 115 selects the lifetime judgment method of the expendable item from the plurality of lifetime judgment methods, based on whether the type of the expendable item is a new genuine product or an imitation product.

The new genuine product is an unused expendable item that has been approved for quality by the manufacturer of the image forming apparatus 100.

Referring to FIG. 3(*b*), when the type of the expendable item is a new genuine product, the engine control unit 115 first detects the reaching of lifetime end, using the detection method by the counter. When detecting the reaching of lifetime end at the time LT1 by the detection method using the counter, the engine control unit 115 starts detecting the reaching of lifetime end using the detection method based on the actually measured value. When detecting the reaching of lifetime end at the time LT2 by the detection method based on the actually measured value, the engine control unit 115 determines that the lifetime end of the expendable item has been reached. As a result, when the type of the expendable item is a new genuine product, the time at which the end of the lifetime is reached is extended from the time LT1 to the time LT2, and the life of the expendable item is lengthened.

Hereinafter, the lifetime judgment method shown in FIG. 3(*b*) may be referred to as extended lifetime judgment method. The extended lifetime judgment method is a lifetime judgment method for prolonging the life of expendable items.

The detection method by the counter is a method of detecting the reaching of the lifetime end of the expendable item when the counter value of the nonvolatile memory 122 built in the expendable item installed in the image forming apparatus 100 reaches a predetermined value. The detection method by the counter may be any method as long as it is a method of detecting the lifetime end of the expendable item, based on a value indicating the number of times of operation or the operation time of the expendable item installed in the image forming apparatus 100. The detection method by the counter is not limited to the above-described method.

The detection method based on the actually measured value is a method for detecting the reaching of the lifetime end of the expendable item, when the actually measured value relating to the expendable item installed in the image forming apparatus 100 deviates from a predetermined range (an example of a first range). The detection method based on the actually measured value may be any method as long as it is a method of detecting the reaching of the lifetime end of the expendable item, based on the actually measured value relating to the expendable item installed in the image forming apparatus 100. The detection method based on the actually measured value is not limited to the above-described method. In addition, it is preferable that the actually measured value relating to expendable items used in the detection method based on the actually measured value is at least one of the physical property value of the expendable item and the density of the image formed using the expendable item. As an example, in the detection method based on the actually measured value, the density of the formed image may be measured using an image reading unit (an inline sensor) provided on the downstream side of the fixing unit. Based on the measurement result, it may be determined whether or not the lifetime end has been reached.

The detection method based on the actually measured value will be described in detail in the seventh embodiment.

Referring to FIG. 4(*a*), the imitation product is an expendable item that is not a genuine item, and is an expendable item that has not received quality certification from the manufacturer of the image forming apparatus 100.

Referring to FIG. 4(*b*), the engine control unit 115 concurrently performs detection of the reaching of lifetime end using the detection method by the counter and detection of the reaching of lifetime end using the detection method based on the actually measured value, in the case where the type of the expendable item is an imitation product. The engine control unit 115 determines that the lifetime of the expendable item has been reached, when the reaching of lifetime end is detected at the time LT3 in at least one of the detection method by the counter and the detection method based on the actually measured value.

Thereafter, the lifetime judgment method shown in FIG. 4(*b*) may be referred to as a parallel lifetime judgment method.

The possibility that the performance of the imitation is inferior to the performance of the new genuine product is high, so that the manufacturer of the image forming apparatus 100 can not guarantee its quality. Therefore, before the counter value of the nonvolatile memory 122 reaches a predetermined value, the performance of the expendable item may deteriorate, and the quality of the image may deteriorate. For these reasons, the engine control unit 115 adopts a parallel lifetime judgment method when the type of expendable items is an imitation product. As a result, the engine control unit 115 compensates the detection result of the detection method by the counter with the detection result of the detection method based on the actually measured value.

The engine control unit 115 specifies the type of the expendable item (whether the type of the expendable item is a new genuine item or an imitation item) based on the manufacturing history of the expendable item stored in the nonvolatile memory 122.

FIG. 5 is a diagram showing address mapping of the nonvolatile memory 122, in the first embodiment of the present invention.

Referring to FIG. 5, the nonvolatile memory 122 built in the expendable item installed in the image forming apparatus 100 is composed of three types of storage areas with different addresses. Each storage area can store up to 8 bits of information.

The storage area of addresses 00h to 1Fh is a read-only area (ROM area) in which when data is written at the time of manufacture, writing after that is prohibited. In this storage area, a model identification code indicating the type of the expendable item, a color identification code indicating the filled toner color, a filling amount identification code indicating the filled toner amount, and the like are stored.

The storage area of the addresses 20h to 2Fh is a freely writable area (RAM area) of the image forming apparatus 100. Temporary information on the state during printing operation, such as the counter value, is mainly written in this storage area.

The storage area of the addresses 30h to 3Fh is an area (OTP area) in which the image forming apparatus 100 can rewrite only once. In this storage area, reproduction information indicating whether the expendable item have reached the end of life, is written. As for this reproduction information, all bits are set to "1" unless the expendable item has reached the end of life in the past. On the other hand, if the lifetime end has reached even once, all the bits are rewritten to "0" by the engine control unit 115.

The engine control unit 115 reads this reproduction information, and if all the bits are "1", it specifies that the expendable item is a new genuine product. When all the bits are "0", the engine control unit 115 specifies that the expendable items are non-genuine products.

Figure 6:
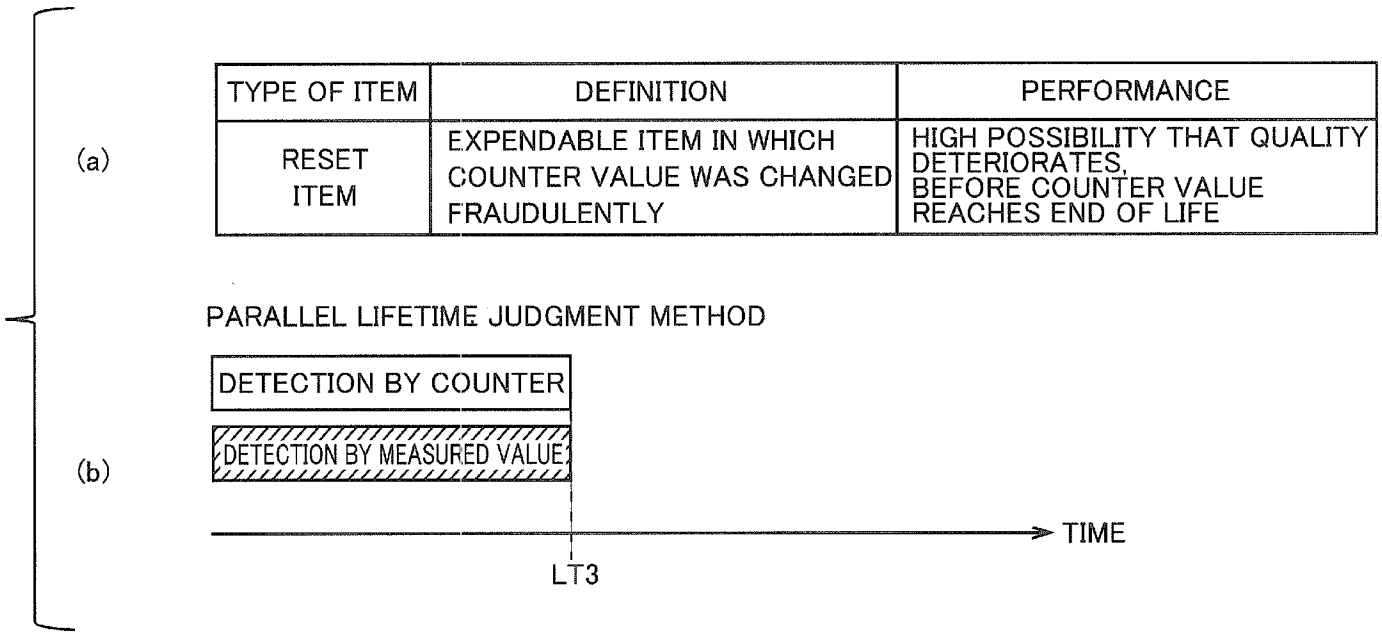
FIG. 6 is a diagram for explaining a lifetime judgment method in the case where the type of the expendable item is a reset product, according to the first embodiment of the present invention.

FIG. 6 is a diagram for explaining a lifetime judgment method in the case where the type of expendable item is the reset item in the first embodiment of the present invention.

Referring to FIG. 6(*a*), the reset item is a kind of an imitation product and is an expendable item that has unjustly changed (rewound) the counter value stored in the expendable item nonvolatile memory 122.

Referring to FIG. 6(*b*), when the unit detection unit 126 detects the replacement of the expendable item, the engine control unit 115 may select the lifetime judgment method of the expendable item from the plurality of lifetime judgment method, based on whether the type of the expendable item is a new genuine product or a reset product. The engine control unit 115 may select a parallel lifetime judgment method, as a lifetime judgment method similarly to the case where the type of the expendable item is a reset item as in the case where the type of expendable item is an imitation item. In this case, the engine control unit 115 may determine that the lifetime of the expendable item has been reached when a reaching of lifetime end is detected at the time LT3 in at least one of the detection method by the counter and the detection method based on the actually measured value.

The engine control unit 115 may determine whether or not the type of expendable item is a reset item, by the following method. The engine control unit 115 measures actual measured value relating to the expendable item at a predetermined timing, and stores them in the main body nonvolatile memory 125 or the like. When the unit detection unit 126 detects replacement of the expendable item, the engine control unit 115 measures an actually measured value relating to the expendable item after the replacement, and stores it in the main body side nonvolatile memory 125 or the like. The engine control unit 115 determines that the type of the expendable item is a reset item, in the case where the difference between the actually measured value relating to the expendable item before the replacement and the actually measured value relating to the expendable item after the replacement is within a predetermined range (an example of a second range).

In the case where the type of the expendable item is a reset product, it is likely that the user took out the old expendable item that has reached the end of life from the image forming apparatus main body 100*a* and the counter value of the old expendable item was rewound by using an IC reseller or the like. Thereafter, it is presumed that the user performed the act of installing the old expendable item again in the image forming apparatus main body 100*a*. In this situation, although the counter value of the expendable item nonvolatile memory 122 is lower than the predetermined value, the performance itself of the expendable items does not change. Therefore, it is possible to judge whether the type of the expendable item is a new genuine product or a reset product by the above method.

Figure 7:
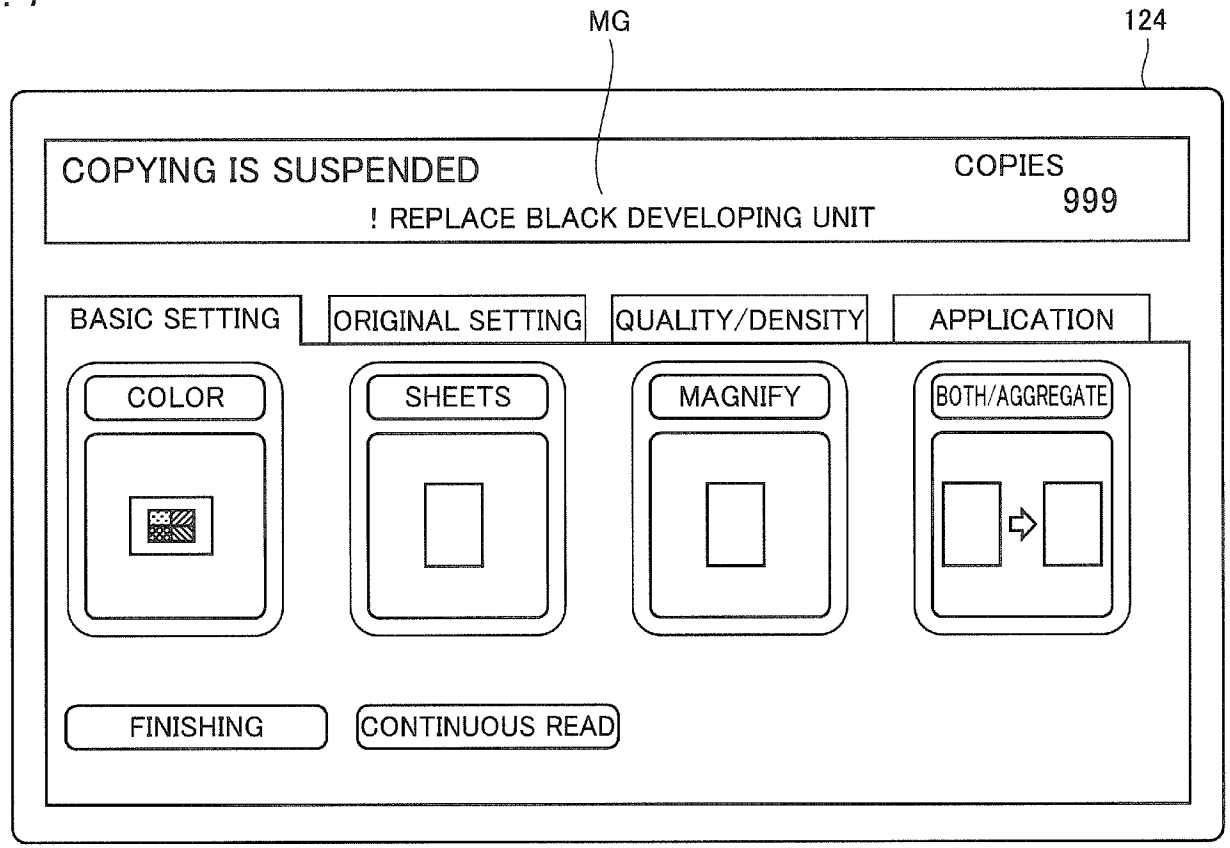
FIG. 7 is a diagram schematically showing a message displayed on the operation panel 124, when the engine control unit 115 determines that the lifetime end of the expendable item has come, in the first embodiment of the present invention.

FIG. 7 is a diagram schematically showing a message displayed on the operation panel 124, when the engine control unit 115 determines that the lifetime end has come in the first embodiment of the present invention.

With reference to FIG. 7, the engine control unit 115 determines that the life of the expendable item has been reached. In that case, the engine control unit 115 displays a message MG prompting the user to replace the expendable item (in this case, K developing unit 31*d*) whose the lifetime end has reached, through the MFP controller 121.

Figure 8:
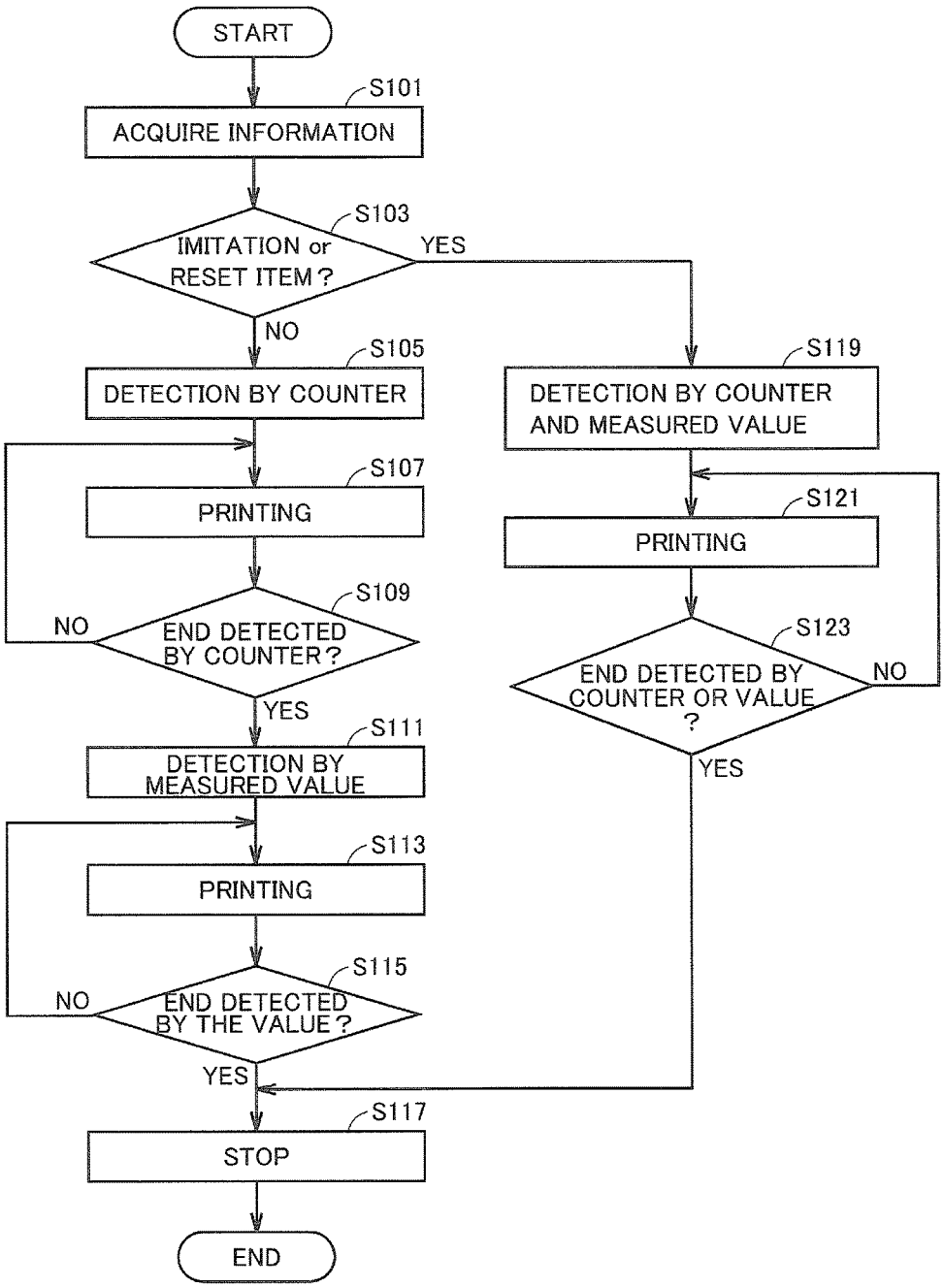
FIG. 8 is a flowchart showing the operation of the image forming apparatus 100 in the case where replacement of an expendable item is detected, by the unit detection unit 126 in the first embodiment of the present invention.

FIG. 8 is a flowchart showing the operation of the image forming apparatus 100 in the case where replacement of the expendable item is detected by the unit detection unit 126, in the first embodiment of the present invention.

Referring to FIG. 8, this flowchart is realized by CPU 101 executing a control program stored in ROM 102. When the unit detecting unit 126 detects the replacement of the expendable item, the CPU 101 acquires necessary information of the expendable item (S101), and judges whether or not the expendable item is an imitation item or a reset item (S103).

In step S101, the CPU 101 acquires the manufacturing history stored in the nonvolatile memory 122 of the expendable item, which is used in determining whether or not the expendable item is an imitation product. In step S101, the CPU 101 acquires (measures) the actually measured value relating to the expendable item, which is used when determining whether or not the expendable item is a reset item.

If it is determined in step S103 that the expendable item is neither an imitation item nor a reset item (NO in S103), the CPU 101 determines that the expendable item is a new genuine item and adopts an extended lifetime judgment method. The CPU 101 starts detection of the reaching of lifetime end using the detection method by the counter (S105), controls the printing operation based on the execution instruction of the user, and updates the counter value (S107). Next, the CPU 101 determines whether or not the reaching of lifetime end has been detected by the detection method by the counter (S109).

In step S109, when it is determined that the reaching of lifetime end is not detected by the detection method by the counter (NO in S109), the CPU 101 proceeds to the processing in step S107.

In step S109, when it is determined that the reaching of lifetime end is detected by the detection method by the counter (YES in S109), the CPU 101 determines that the reaching of lifetime end has been detected by the detection method of the counter. The CPU 101 starts detection of the reaching of lifetime end using the detection method based on the actually measured value (S111), controls the printing operation based on the user's execution instruction, and updates the counter value (S113). Next, the CPU 101 determines whether or not the reaching of lifetime end has been detected by the detection method based on the actually measured value (S115).

In step S115, if it is determined that the reaching of lifetime end is not detected by the detection method based on the actually measured value (NO in S115), the CPU 101 proceeds to the processing in step S113.

In step S115, when it is determined that the reaching of lifetime end is detected by the detection method based on the actually measured value (YES in S115), the CPU 101 determines that the life of the expendable item has been reached. The CPU 101 notifies the user to prompt replacement of the expendable item, stops the operation of the image forming apparatus 100 (S117), and terminates the process.

If it is determined in step S103, that the expendable item is an imitation product or a reset item (YES in S103), the CPU 101 adopts a parallel lifetime judgment method. The CPU 101 starts detection of the reaching of lifetime end using the detection method by the counter, and detection of the reaching of lifetime end using the detection method based on the actually measured value (S119). The CPU 101 controls the printing operation based on the user's execution instruction and updates the counter value (S121). Next, the CPU 101 determines whether or not the lifetime end is detected in at least one of the detection method by the counter and the detection method based on the actually measured value (S123).

In step S123, if it is determined that the lifetime is not detected by either the counter detection method or the actual measurement method (NO in S123), the CPU 101 proceeds to the processing in step S121.

In step S123, when it is determined that the lifetime end is detected in at least one of the detection method by the counter and the detection method based on the actually measured value (YES in S 123), the CPU 101 determines that the life of the expendable item has been reached. The CPU 101 notifies the user to prompt replacement of the expendable item, stops the operation of the image forming apparatus 100 (S 117), and terminates the process.

Second Embodiment

Figure 9:
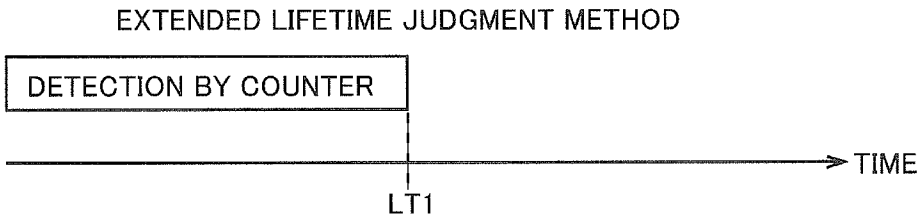
FIG. 9 is a diagram for explaining a lifetime judgment method in the case where the type of the expendable item in the second embodiment of the present invention is a reused item.

FIG. 9 is a diagram for explaining a lifetime judgment method in the case where the type of an expendable item is a reused item, in the second embodiment of the present invention.

With reference to FIG. 9(*a*), in the present embodiment, the engine control unit 115 detects replacement of the expendable item by the unit detection unit 126. In this case, the engine control unit 115 selects the lifetime judgment method of the expendable item from the plurality of lifetime judgment methods, based on whether the type of the expendable item is a new genuine item or a reused item.

The reused item is an expendable item that has been certified for quality by the manufacturer of the image forming apparatus 100, and that can be reused by exchanging a consumed portion.

Referring to FIG. 9(*b*), when the type of the expendable item is a reused item, the engine control unit 115 does not detect the reaching of lifetime end using the detection method based on the actually measured value. The engine control unit 115 detects the reaching of lifetime end using the detection method by the counter. When detecting the reaching of lifetime end at the time LT1 by the detection method by the counter, the engine control unit 115 determines that the life of the expendable item has been reached.

Thereafter, the lifetime judgment method shown in FIG. 9(*b*) may be referred to as a lifetime judgment method only by the number of times.

Generally, a reused item is certified for quality from the manufacturer of the image forming apparatus 100, until the counter value of the expendable item reaches a predetermined value. On the other hand, the unexhausted parts of the reused items are not replaced, they remain old, so it is not possible to expect the same performance as the new genuine article in the reused items. Under such circumstances, the engine control unit 115 does not extend the lifetime unlike a brand-new genuine product, when the type of expendable item is a reused item. When detecting the reaching of lifetime end by the detection method by the counter, the engine control unit 115 determines that the life of the expendable item has been reached.

When the type of the expendable item is a brand-new genuine product, the engine control unit 115 adopts an extended lifetime judgment method similarly to the first embodiment.

The engine control unit 115 specifies the type of the expendable item (whether the type of the expendable item is a new genuine product or a reused item), based on the manufacturing history (number of recycling) of expendable items stored in the nonvolatile memory 122.

The engine control unit 115 may regard the item as a reused item and adopt a lifetime judgment method only by the number of times, when the number of times of recycling stored in the nonvolatile memory 122 exceeds the predetermined number of times. When it does not exceed the predetermined number of times, an extended lifetime judgment method as a new genuine item may be adopted.

Figure 10:
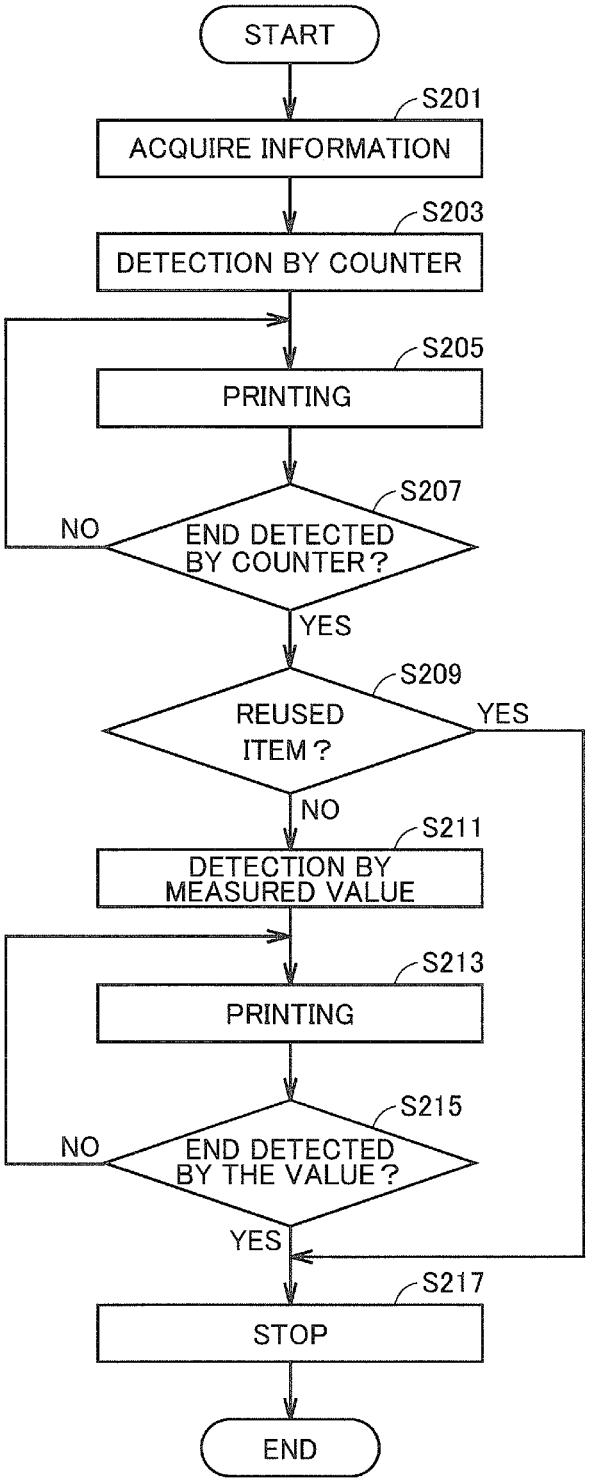
FIG. 10 is a flowchart showing the operation of the image forming apparatus 100 in the case where replacement of an expendable item is detected by the unit detection unit 126 in the second embodiment of the present invention.

FIG. 10 is a flowchart showing the operation of the image forming apparatus 100 in the case where replacement of the expendable item is detected by the unit detection unit 126, in the second embodiment of the present invention.

With reference to FIG. 10, this flowchart is realized by CPU 101 executing a control program stored in ROM 102. When the unit detecting unit 126 detects the replacement of the expendable item, the CPU 101 acquires the manufacturing history stored in the nonvolatile memory 122 of the expendable item (S201). Next, the CPU 101 starts detection of the reaching of lifetime end using the detection method by the counter (S203), controls the printing operation based on the execution instruction of the user, and updates the counter value (S205). Next, the CPU 101 determines whether or not the reaching of lifetime end has been detected by the detection method by the counter (S207).

In step S207, when it is determined that the reaching of lifetime end is not detected by the detection method by the counter (NO in S207), the CPU 101 proceeds to the processing in step S205.

In step S207, when it is determined that the reaching of lifetime end is detected by the detection method by the counter (YES in S207), the CPU 101 determines that the reaching of lifetime end has been detected by the detection method by the counter. In this case, the CPU 101 determines whether or not the expendable item is a reused item based on the manufacturing history information acquired in step S201 (S209).

If it is determined in step S209 that the expendable item is a reused item (YES in step S209), the CPU 101 adopts a lifetime judgment method only by the number of times. The CPU 101 determines that the life of the expendable item has been reached, notifies the user to prompt replacement of the expendable item (S217), and terminates the process.

If it is determined in step S209 that the expendable item is not a reused item (NO in step S209), the CPU 101 determines that the expendable item is a new genuine item and adopts the extended lifetime judgment method. The CPU 101 starts detection of the reaching of lifetime end using the detection method based on the actually measured value (S211), controls the printing operation based on the execution instruction of the user, and updates the counter value (S213). Next, the CPU 101 determines whether or not the reaching of lifetime end has been detected by the detection method based on the actually measured value (S215).

In step S215, when it is determined that the reaching of lifetime end is not detected by the detection method based on the actually measured value (NO in S215), the CPU 101 proceeds to the processing in step S213.

In step S215, when the CPU 101 determines that the life of the expendable item has been reached, it is determined that the reaching of lifetime end is detected by the detection method based on the actually measured value (YES in S215). The CPU 101 notifies the user to prompt the user to replace the expendable item, stops the operation of the image forming apparatus 100 (S217), and terminates the process.

The configuration of the image forming apparatus according to the present embodiment and operations other than those described above are similar to those of the image forming apparatus according to the first embodiment, so description thereof will not be repeated.

Third Embodiment

The third and fourth embodiments are combined with the above-described first or second embodiment.

Referring to FIG. 1, image forming apparatus 100 includes a set of Y developing unit 31*a* and photosensitive member unit 32*a* as a set of expendable items. The image forming apparatus 100 includes a set of M developing unit 31*b* and photosensitive member unit 32*b* as a set of expendable items. The image forming apparatus 100 includes a set of C developing unit 31*c* and photosensitive member unit 32*c* as a set of expendable items. The image forming apparatus 100 includes a set of K developing unit 31*d* and photosensitive member unit 32*d* as a set of expendable items.

Here, attention is paid to a combination of K developing unit 31*d* and photosensitive member unit 32*d*. When a detection method based on actually measured value is performed on the developing unit 31*d* or the photosensitive member unit 32*d*, a K toner image is formed on the intermediate transfer belt 34 (or on the photosensitive member 81) by the developing unit 31*d* and the photosensitive member unit 32*d*. A method of detecting the lifetime of the developing unit 31*d* or the photosensitive member unit 32*d* by measuring the toner adhesion amount in the formed toner image may be used in some cases.

In this situation, the obtained actually measured value indicates the performance of both the developing unit 31*d* and the photosensitive member unit 32*d*. For this reason, it is impossible to obtain an accurate measured value for one expendable item, in the case where the type of expendable item of one of the developing unit 31*d* and the photosensitive member unit 32*d* is genuine and the type of the other expendable item is non-genuine, Therefore, the engine control unit 115 selects the lifetime judgment method only by the number of times, instead of the extended lifetime judgment method, as the lifetime judgment method of the one expendable item, in the case where the type of expendable item of one of the developing unit 31*d* and the photosensitive member unit 32*d* is genuine and the type of the other expendable item is non-genuine.

FIG. 11 is a diagram showing a relationship between a combination of a developing unit and a consumable unit and a lifetime judgment method to be adopted, in a third embodiment of the present invention.

Referring to FIG. 11, the case 1 is a case where both the developing unit and the photosensitive member unit are genuine products. In Case 1, an extended lifetime judgment method is adopted for each of the developing unit and the photosensitive member unit.

Case 2 is a case where the developing unit is a non-genuine product and the photosensitive member unit is a genuine product. In Case 3, a lifetime judgment method corresponding to the type of the expendable item is adopted for the development unit, and a lifetime judgment method only by the number of times is adopted for the photosensitive member unit.

Case 3 is a case where the developing unit is a genuine product and the photosensitive member unit is a non-genuine product. In Case 3, a lifetime judgment method only by the number of times for the development unit is adopted, and for the photosensitive member unit, a lifetime judgment method corresponding to the type of expendable item is adopted.

Case 4 is a case where both the developing unit and the photosensitive member unit are non-genuine products. In Case 4, for each of the developing unit and the photosensitive member unit, a lifetime judgment method corresponding to the type of expendable item is adopted.

The configuration of the image forming apparatus according to the present embodiment and operations other than those described above are similar to the configurations and operations of the image forming apparatus according to the first or second embodiment, so description thereof will not be repeated.

Fourth Embodiment

Figure 12:
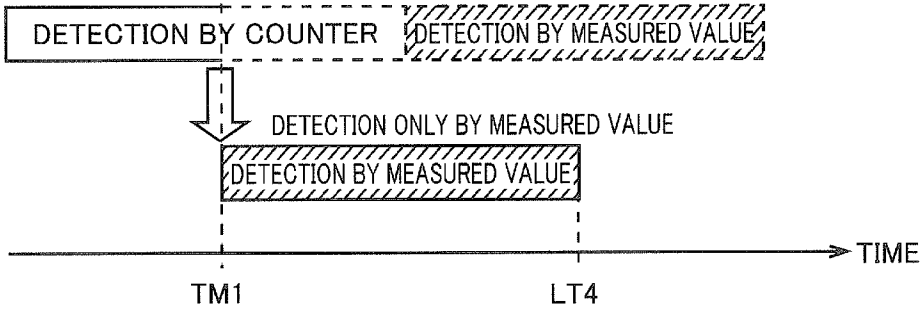
FIG. 12 is a view for explaining a lifetime judgment method in the case where the type of the expendable item is a genuine product and the counter failure of the expendable item occurs in the fourth embodiment of the present invention.

FIG. 12 is a diagram for explaining a lifetime judgment method in the fourth embodiment of the present invention, in the case where the type of the expendable item is genuine and the counter failure of the expendable item occurs.

Referring to FIG. 12, a counter value which is a value indicative of the number of times of operation or operation time of expendable items is stored in a rewritable area in nonvolatile memory 122 or main body side nonvolatile memory 125. The engine control unit 115 counts up the counter value every time the image forming apparatus 100 is used. Also, the expendable item is genuine products, an extended lifetime judgment method is selected, and end of lifetime is being detected using the detection method by the counter.

Under such circumstances, at the time TM1 during which the engine control unit 115 is updating the counter value, when the power of the image forming apparatus 100 is turned off or communication failure between the engine control unit 115 and the nonvolatile memory 122 or the main body side nonvolatile memory 125 occurs, an abnormality occurs in the counter value, and the detection method by the counter can not be continued. When such a situation occurs, conventionally, it is judged that a trouble has occurred, the operation of the image forming apparatus is stopped, and the replacement of expendable items has been urged.

When the extended lifetime judgment method is selected and the counter value becomes unusable during the detection of the reaching of lifetime end using the counter detection method, the engine control unit 115 according to the present embodiment starts detecting the reaching of lifetime end based on the detection method by the actually measured value, regardless of the detection result of the detection method by the counter. The engine control unit 115 starts detection of the reaching of lifetime end by the detection method based on the actually measured value at the time TM1 and determines that the lifetime of the expendable item has been reached, when the reaching of lifetime end at the time LT4 is detected by the detection method based on the actually measured value.

The configuration of the image forming apparatus according to the present embodiment and operations other than those described above are similar to the configurations and operations of the image forming apparatus according to the first or second embodiment, so description thereof will not be repeated.

Fifth Embodiment

Figure 13:
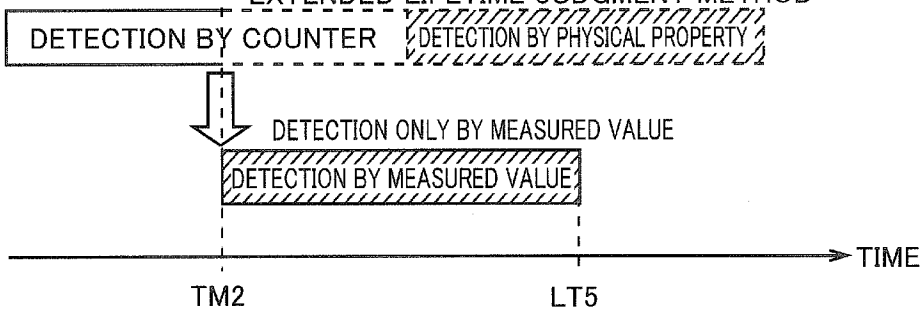
FIG. 13 is a diagram for explaining a lifetime judgment method in the case where the type of expendable items is second hand in the fifth embodiment of the present invention.

FIG. 13 is a diagram for explaining a lifetime judgment method in the case where the type of the expendable item is a secondhand item (old product), in the fifth embodiment of the present invention.

Referring to FIG. 13(*a*), in the present embodiment, the engine control unit 115 selects a lifetime judgment method for the expendable item from a plurality of lifetime judgment methods, based on whether the type of the expendable item is a new genuine product or a secondhand item, when replacement of the expendable item is detected by the unit detection unit 126.

Secondhand items are expendable items that are not brand-new and have been certified for quality by the manufacturer of the image forming apparatus 100, and that have not reached their lifetime yet.

With reference to FIG. 13(*b*), the expendable item which is a secondhand item is removed from another image forming apparatus during the detection of the arrival of the end of life using the detection method by the counter in the extended lifetime judgment method. The expendable item which is secondhand is assumed to be installed in the image forming apparatus 100 at time TM2. In the case where the installed expendable item is a secondhand item, the engine control unit 115 does not detect the reaching of lifetime end using the detection method by the counter. The engine control unit 115 detects the reaching of lifetime end using the detection method based on the actually measured value. When detecting the reaching of lifetime end at the time LT5 by the detection method based on the actually measured value, the engine control unit 115 determines that the life of the expendable item has been reached.

Thereafter, the lifetime judgment method shown in FIG. 13(*b*) may be referred to as a lifetime judgment method only by an actually measured value.

Some of the expendable items do not include the nonvolatile memory 122 (memory chip). It is assumed that a secondhand expendable item not including the nonvolatile memory 122 is detached from another image forming apparatus and installed in the image forming apparatus 100. In this case, the service person usually acquires the counter value of the expendable item from the main body side nonvolatile memory of the another image forming apparatus. The service person performs an operation of inputting the acquired counter value to the main body side nonvolatile memory 125 of the image forming apparatus 100 at the installation destination. In this work, it is likely for a service person to cause inputting error of the counter value or to forget to input. When a service person cause inputting error of the counter value or forgets to input, the detection of the reaching of lifetime end using the counter detection method becomes inaccurate. So, the timing of starting the detection method based on the actually measured value may be delayed and there is a fear that deterioration of the image quality occurs before judging that the life of the expendable item has reached. For these reasons, the engine control unit 115 does not detect the reaching of lifetime end with the detection method by the counter, when the type of the expendable item is a secondhand item. The engine control unit 115 detects the reaching of lifetime end, using the detection method based on the actually measured value.

If the manufacturing history of the expendable item stored in the nonvolatile memory 122 is not a new item, when the replacement of the expendable item is detected by the unit detection unit 126, the engine control unit 115 specifies the expendable item as a secondhand item.

Figure 14:
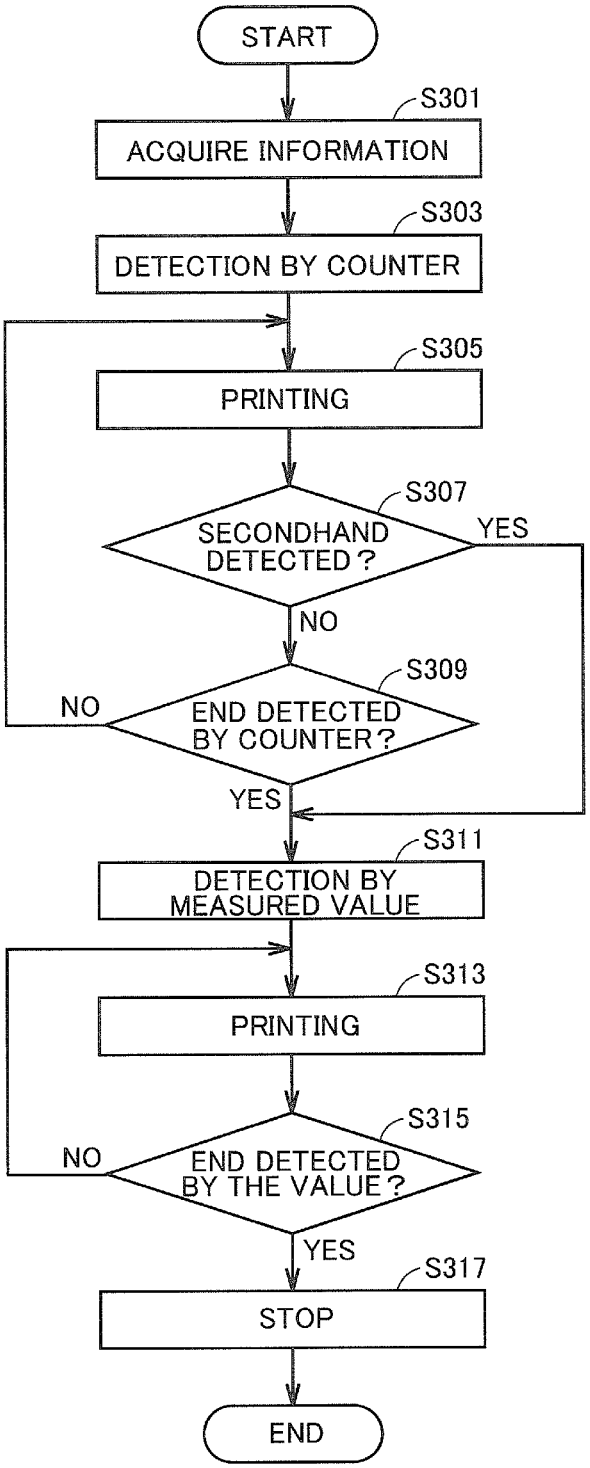
FIG. 14 is a flowchart showing the operation of the image forming apparatus 100 in the case where replacement of an expendable item is detected by the unit detection unit 126 in the fifth embodiment of the present invention.

FIG. 14 is a flowchart showing the operation of the image forming apparatus 100 in the case where replacement of expendable items is detected by the unit detection unit 126, in the fifth embodiment of the present invention.

Referring to FIG. 14, this flowchart is realized by CPU 101 executing a control program stored in ROM 102. When the unit detecting unit 126 detects the replacement of the expendable item, the CPU 101 acquires the manufacturing history stored in the nonvolatile memory 122 of the expendable item (S301). Next, the CPU 101 adopts the extended lifetime judgment method and starts detecting the reaching of lifetime end using the detection method by the counter (S303). Subsequently, the CPU 101 controls the printing operation based on the user's execution instruction and updates the counter value (S305). Next, the CPU 101 determines whether or not replacement to a secondhand expendable item is detected (S307).

If it is determined in step S307 that replacement to a secondhand expendable item is not detected (NO in step S307), the CPU 101 determines in step S309 whether or not the reaching of lifetime end has been detected by the detection method by the counter.

In step S309, when it is determined that the reaching of lifetime end is detected by the detection method by the counter (YES in S309), the CPU 101 proceeds to the processing in step S311.

In step S309, when it is determined that the reaching of lifetime end is not detected by the detection method by the counter (NO in S309), the CPU 101 proceeds to the processing in step S305.

If it is determined in step S307 that replacement to an expendable item that is a secondhand item has been detected (YES in step S307), the CPU 101 changes the lifetime judgment method to the lifetime judgment method only by the actually measured value. The CPU 101 starts detecting the reaching of lifetime end using the detection method based on the actually measured value (S311), and controls the printing operation based on the user's execution instruction and update the counter value (S313). Next, the CPU 101 determines whether or not the reaching of lifetime end has been detected by the detection method based on the actually measured value (S315).

If it is determined in step S315 that the reaching of lifetime end is not detected by the detection method based on the actually measured value (NO in S315), the CPU 101 proceeds to the process of step S313.

In step S315, when it is determined that the reaching of lifetime end is detected by the detection method based on the actually measured value (YES in S315), the CPU 101 determines that the life of the expendable item has been reached. The CPU 101 notifies the user to prompt the user to replace the expendable item, stops the operation of the image forming apparatus 100 (S317), and ends the process.

The configuration of the image forming apparatus according to the present embodiment and operations other than those described above are similar to those of the image forming apparatus according to the first embodiment, so description thereof will not be repeated.

Sixth Embodiment

FIG. 15 is a diagram showing the relationship between the information stored in the nonvolatile memory 122 of the expendable item and the lifetime judgment method, according to the sixth embodiment of the present invention.

Referring to FIG. 15, in the present embodiment, the nonvolatile memory 122 of the expendable item stores information indicative of a lifetime judgment method to be adopted for the expendable item. Based on the information stored in the nonvolatile memory 122 of the expendable item, the engine control unit 115 selects the lifetime judgment method of the expendable item from the plurality of lifetime judgment methods. In other words, the type of expendable item in the present embodiment is information that indicates the lifetime judgment method stored in the expendable item.

In the present embodiment, the engine control unit 115 includes a first lifetime judgment method, a second lifetime judgment method, and a third lifetime judgment method as a plurality of lifetime judgment methods. The first lifetime judgment method is an extended lifetime judgment method. The second lifetime judgment method is a lifetime judgment method only by the number of times. The third lifetime judgment method is a parallel lifetime judgment method.

The expendable item nonvolatile memory 122 has a 2-bit area of "bit 1" and "bit 2" as an area for storing information indicative of a lifetime judgment method to be adopted for the expendable item. The data of each of "bit 1" and "bit 2" can be rewritten only once from "1" to "0". It is impossible to rewrite from "1" to "0" twice or more, or rewrite from "0" to "1".

When the lifetime judgment method to be adopted in the expendable item is the first lifetime judgment method, data "1" is recorded in "bit 1" and data "0" is recorded in "bit 2". When the lifetime judgment method to be adopted in the expendable item is the second lifetime judgment method, data "0" is recorded in "bit 1" and data "1" is recorded in "bit 2". When the lifetime judgment method to be adopted in the expendable item is the third lifetime judgment method, data "0" is recorded in "bit 1" and "bit 2".

In the case where the expendable item is a genuine item of a new item (at the beginning of distribution) that is not determined to be able to extend the life, information ("0" as "bit 1" and "1" as "bit 2") indicative of the second lifetime judgment method is written in the expendable item nonvolatile memory 122. This writing is done in the factory at the time of production of expendable items.

Genuine products in the early stage of distribution have poor track record of use in the market, so it is difficult to accurately evaluate their performance, and it is unknown whether or not the lifetime can be prolonged. Therefore, for the genuine products at the beginning of distribution, the lifetime judgment method only by the number of times is adopted.

Meanwhile, when a certain period of time has elapsed since the start of the distribution of expendable items, information such as variations in performance among products for the expendable items and evaluation results on the market is often obtained. Based on these obtained information, the manufacturer determines whether or not it is possible to prolong the life of expendable items. When it is determined that the life of expendable items can be extended, information indicative of the first lifetime judgment method is written in the nonvolatile memory 122 of the expendable item to be manufactured thereafter (Data "1" for "bit1" and "0" for "bit 2"). This writing is done in the factory at the time of production of expendable items.

The image forming apparatus 100 rewrites the data so that "bit 1" and "bit 2" both become "0" when the life of the expendable item installed in the image forming apparatus main body 100*a* comes. As a result, the information stored in the expendable item nonvolatile memory 122 is rewritten to the information indicative of the third lifetime judgment method, irrespective of whether the information stored in the expendable item nonvolatile memory 122 was information indicative of the first lifetime judgment method or information indicative of the second lifetime judgment method. As a result, in the case where the expendable item whose life has come was reused as a reused item or a reset item, a lifetime judgment method based on only measured value is adopted, and it is possible to appropriately judge the reaching of the lifetime end of expendable items. In addition, it is possible to rewrite data of "bit 1" and "bit 2" only once from "1" to "0". Therefore, it is possible to prevent tampering with unauthorized data, and it is possible to rewrite data only to a more secure side.

Only two of the above first to third lifetime judgment methods may be adopted.

Figure 16:
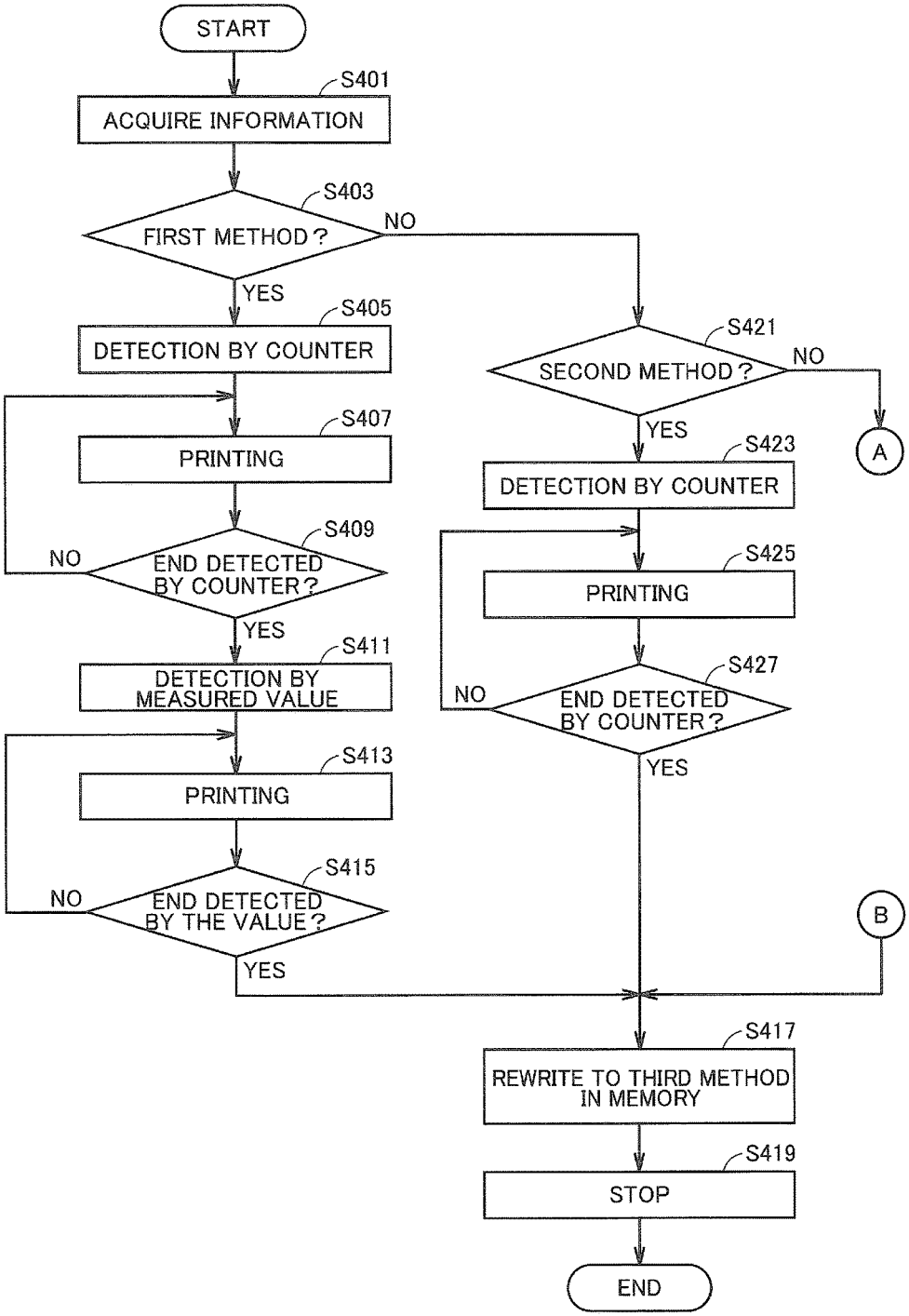
FIG. 16 is a first part of a flowchart showing the operation of the image forming apparatus 100 in the case where replacement of an expendable item is detected by the unit detection unit 126, in the sixth embodiment of the present invention.
Figure 17:
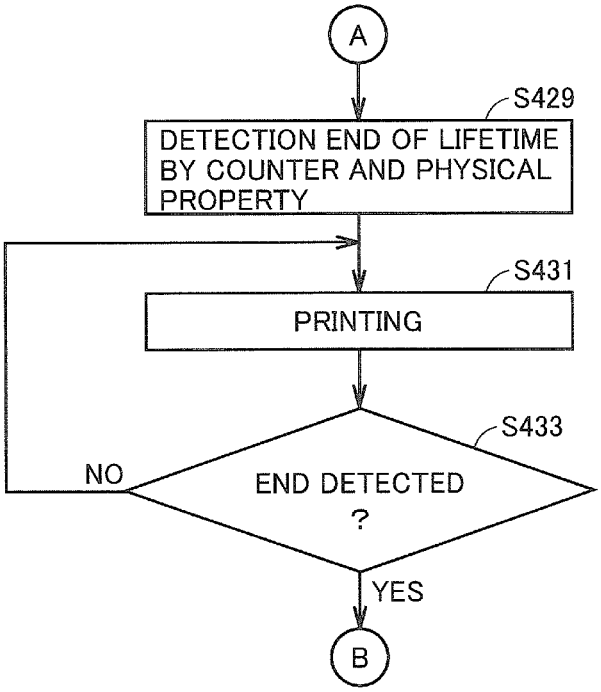
FIG. 17 is a second part of a flowchart showing the operation of the image forming apparatus 100 in the case where replacement of an expendable item is detected by the unit detection unit 126, in the sixth embodiment of the present invention.

FIGS. 16 and 17 are flowcharts showing the operation of the image forming apparatus 100 in the case where replacement of the expendable item is detected by the unit detection unit 126, in the sixth embodiment of the present invention.

Referring to FIG. 16, this flowchart is realized by CPU 101 executing a control program stored in ROM 102. When the unit detecting unit 126 detects the replacement of the expendable item, the CPU 101 acquires the information stored in the nonvolatile memory 122 of the expendable item (S401). Next, on the basis of the information acquired from the expendable item nonvolatile memory 122, the CPU 101 determines whether or not the lifetime judgment method to be adopted for the expendable item is the first lifetime judgment method (S403).

If it is determined in step S403 that the lifetime judgment method to be adopted for the expendable item is the first lifetime judgment method (YES in S403), the CPU 101 adopts the extended lifetime judgment method. The CPU 101 starts detection of the reaching of lifetime end using the detection method by the counter (S405), controls the printing operation based on the user's execution instruction, and updates the counter value (S407). Next, the CPU 101 determines whether or not the reaching of lifetime end has been detected by the detection method by the counter (S409).

In step S409, when it is determined that the reaching of lifetime end is not detected by the detection method by the counter (NO in S409), the CPU 101 proceeds to the processing in step S407.

In step S409, when it is determined that the reaching of lifetime end has been detected by the detection method by the counter (YES in S409), the CPU 101 determines that the reaching of lifetime end has been detected by the detection method by the counter. The CPU 101 starts detection of the reaching of lifetime end using the detection method based on the actually measured value (S411), controls the printing operation based on the user's execution instruction, and updates the counter value (S413). Next, the CPU 101 determines whether or not the reaching of lifetime end has been detected by the detection method based on the actually measured value (S415).

In step S415, when it is determined that the reaching of lifetime end is not detected by the detection method based on the actually measured value (NO in S415), the CPU 101 proceeds to the processing in step S413.

In step S415, when it is determined that the reaching of lifetime end is detected by the detection method based on the actually measured value (YES in S415), the CPU 101 determines that the lifetime end life of the expendable item has been reached. The CPU 101 rewrites the information stored in the expendable item nonvolatile memory 122 to information that indicates the third lifetime judgment method (S417). The CPU 101 notifies the user to prompt replacement of the expendable item, stops the operation of the image forming apparatus 100 (S419), and terminates the process.

If it is determined in step S403 that the lifetime judgment method to be adopted for the expendable item is not the first lifetime judgment method (NO in S403), the CPU 101 determines whether or not the lifetime judgment method to be adopted for the expendable item is the second lifetime judgment method (S421), based on the information acquired from the expendable item nonvolatile memory 122.

If it is determined in step S421 that the lifetime judgment method to be adopted for the expendable item is the second lifetime judgment method (YES in step S421), the CPU 101 adopts a lifetime judgment method only by the number of times. The CPU 101 starts detection of the reaching of lifetime end using the detection method by the counter (S423), controls the printing operation based on the execution instruction of the user, and updates the counter value (S425). Next, the CPU 101 determines whether or not the reaching of lifetime end has been detected by the detection method by the counter (S427).

In step S427, when it is determined that the reaching of lifetime end is not detected by the detection method by the counter (NO in S427), the CPU 101 proceeds to the process of step S425.

In step S427, when it is determined that the reaching of lifetime end is detected by the detection method by the counter (YES in S427), the CPU 101 determines that the life of the expendable item has been reached. The CPU 101 rewrites the information stored in the expendable item nonvolatile memory 122 to information that indicates the third lifetime judgment method (S417). The CPU 101 notifies the user to prompt replacement of the expendable item, stops the operation of the image forming apparatus 100 (S419), and terminates the process.

If it is determined in step S421 that the lifetime judgment method to be employed for the expendable item is not the second lifetime judgment method (YES in step S421), the CPU 101 proceeds to the processing in step S429 in FIG. 17.

Referring to FIG. 17, in step S429, the CPU 101 determines that the lifetime judgment method to be adopted for the expendable item is the third lifetime judgment method, and adopts a parallel lifetime judgment method. The CPU 101 starts detection of the reaching of lifetime end using the detection method by the counter and detection of the reaching of lifetime end using the detection method based on the actually measured value (S429). The CPU 101 controls the printing operation based on the user's execution instruction and updates the counter value (S431). Next, the CPU 101 determines whether or not the life is detected in at least one of the detection method by the counter and the detection method based on the actually measured value (S433).

In step S433, when it is determined that the lifetime is not detected (NO in S433) by the detection method by the counter or the detection method by the actually measured value, the CPU 101 proceeds to the processing in step S431.

In step S433, when it is determined that the life is detected in at least one of the detection method by the counter and the detection method based on the actually measured value (YES in S433), the CPU 101 determines that the life of the expendable item has been reached. The CPU 101 rewrites the information stored in the expendable item nonvolatile memory 122 to information that indicates the third lifetime judgment method (S417 in FIG. 16). The CPU 101 notifies the user to prompt replacement of the expendable item, stops the operation of the image forming apparatus 100 (S419 in FIG. 16), and ends the process.

The configuration of the image forming apparatus according to the present embodiment and operations other than those described above are similar to those of the image forming apparatus according to the first embodiment, so description thereof will not be repeated.

Seventh Embodiment

In the present embodiment, a detection method based on an actually measured value will be described in detail.

(1) Detection method of the end of lifetime, using the detection method based on the actually measured value for the developing unit 31

As a premise of the present embodiment, the engine control unit 115 performs image stabilization control at necessary timing. The image stabilization control is to review the bias condition of each part, so that the density of the image to be formed becomes the target density. Since the optimum bias condition varies depending on the progress of durable use and environmental conditions, image stabilization processing is performed at necessary timing. In the present embodiment, attention is focused particularly on the adhesion amount control in this image stabilization control. The adhesion amount control is to adjust the developing bias, so that the amount of toner attached to the photosensitive member 81 by the developing unit 31 is optimized.

Figure 18:
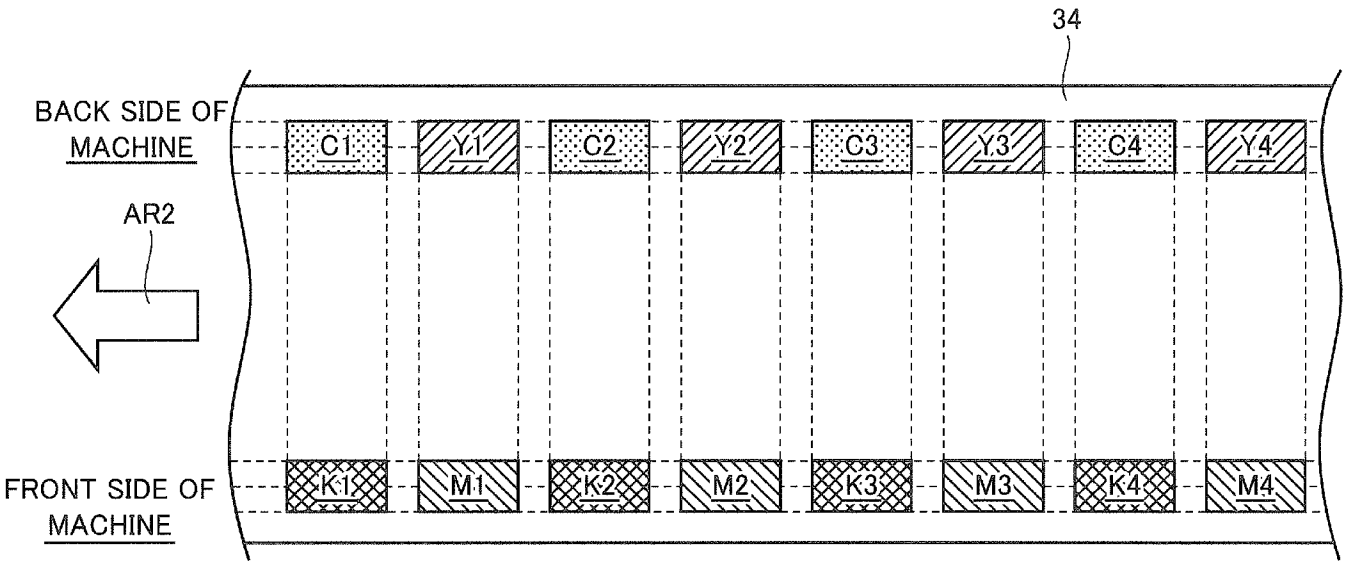
FIG. 18 is a plan view showing a pattern formed by adhesion amount control in a seventh embodiment of the present invention.
Figure 19:
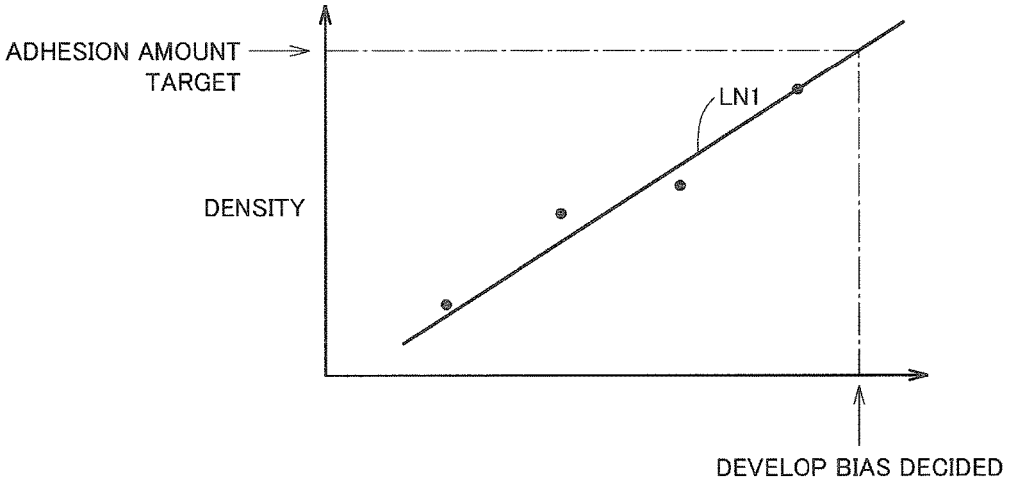
FIG. 19 is a graph plotting the relationship between developing bias and density in adhesion amount control in the seventh embodiment of the present invention.

FIG. 18 is a plan view showing a pattern formed by the adhesion amount control in the seventh embodiment of the present invention. FIG. 19 is a graph plotting the relationship between the developing bias and the density in the adhesion amount control, in the seventh embodiment of the present invention.

Referring to FIGS. 18 and 19, when controlling the adhesion amount, the engine control unit 115 creates patterns of four colors on the intermediate transfer belt 34 with four types of developing bias. The engine control unit 115 measures the density of the formed pattern with the density detection sensor 116. The engine control unit 115 plots the relationship between the developing bias of each color and the density, and calculates the approximate straight line LN1. The engine control unit 115 determines the developing bias corresponding to the density of the target adhesion amount using the approximate straight line LN1. Basically, in the subsequent image formation, the developing bias determined by this method is used. The above-described developing bias is determined independently for each color.

The engine control unit 115 stores the developing biases determined by the adhesion amount control in the nonvolatile memory 122 together with the environmental value measured by the environmental sensor 123, when the adhesion amount control is performed. Further, the engine control unit 115 also stores the cumulative number of printed sheets of the developing unit 31 and the cumulative rotation time of the photosensitive member 81 at the time when the adhesion amount control is performed, in the nonvolatile memory 122.

Figure 20:
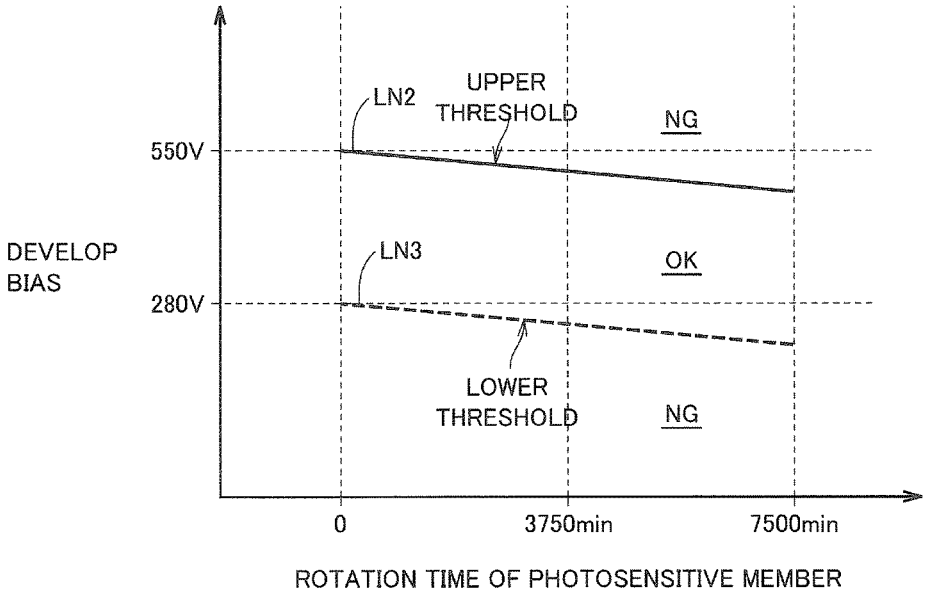
FIG. 20 is a graph showing an allowable range of a developing bias in the case of detecting end of lifetime, using a detection method based on an actually measured value of the developing unit 31, in the seventh embodiment of the present invention.

FIG. 20 is a graph showing the allowable range of the developing bias in the case of detecting the reaching of lifetime end using the detection method based on the actually measured value of the developing unit 31, in the seventh embodiment of the present invention.

Referring to FIG. 20, in the graph, a straight line LN2 going down to the right as "upper limit threshold" and a straight line LN3 going down to the right as "lower limit threshold" are drawn. The fact that the developing bias exceeds the upper limit threshold means that the toner conveying ability of the developing unit 31 has decreased beyond the allowable range. The fact that the developing bias falls below the lower limit threshold means that the charge amount of the toner has increased beyond the allowable range. Therefore, the region between the straight line LN2 and the straight line LN3 is an OK region (a range in which end of lifetime is not detected). Both outer sides of the straight line LN2 and the straight line LN3 are NG regions (ranges in which end of lifetime is detected).

Both the straight line LN2 and the straight line LN3 tend to go down in parallel as the cumulative rotation time of the photosensitive member increases. Each of the straight line LN2 and the straight line LN3 is represented by the following formulas (1) and (2). Since the numerical values in Expressions (1) and (2) are examples of experimentally determined values, they may differ depending on colors and individuals.

$$\text{Upper limit threshold } [V] = 550 - 0.0081 \times \text{cumulative rotation time of the photosensitive member [minutes]} \quad (1)$$

$$\text{Lower limit threshold } [V] = 280 - 0.0081 \times \text{cumulative rotation time of the photosensitive member [minutes]} \quad (2)$$

When detecting the reaching of lifetime end using the detection method based on the actually measured value, the engine control unit 115 reads the developing bias value and the cumulative rotation time of the photosensitive member 81 at that time, from the nonvolatile memory 122, and plots them in FIG. 20. If the plot is within the OK area, the engine control unit 115 does not detect end of lifetime of the developing unit 31. On the other hand, if the plot is within the NG area, the engine control unit 115 detects end of lifetime of the developing unit 31.

The detection of the reaching of lifetime end using the detection method based on the actually measured value of the development unit may be performed by using the table shown in FIG. 21 instead of the above-described method.

FIG. 21 is a table showing another example of the allowable range of the developing bias in the case of detecting the reaching of lifetime end using the detection method based on the actually measured value of the developing unit 31, in the seventh embodiment of the present invention.

Referring to FIG. 21, in this table, an upper limit threshold value and a lower limit threshold value are determined for each of Y, M, C, and K. The upper limit threshold value and the lower limit threshold value are set to different values in the case where the cumulative number of revolutions of the photosensitive member 81 is less than 300 thousand revolutions and the case where it is 300 thousand revolutions or more, respectively. Any threshold value for 300 thousand revolutions or more is smaller than the corresponding threshold value for less than 300 thousand revolutions. This is the same reason why the graph in FIG. 20 is downward sloping downward.

The engine control unit 115 reads the developing bias value and the cumulative number of revolutions of the photosensitive body 81 at that time from the nonvolatile memory 122. The engine control unit 115 determines whether the cumulative number of revolutions of the photosensitive member 81 is less than 300 thousand revolution, or 300 thousand revolution or more. The engine control unit 115 judges whether the read developing bias value is within the OK area or the NG area by using the upper limit threshold and the lower limit threshold of the corresponding one. The engine control unit 115 does not detect end of lifetime of the developing unit 31, if the read developing bias value is within the OK area. When the read developing bias value is within the NG area, the engine control unit 115 detects end of lifetime of the developing unit 31.

(2) Detection method of end of lifetime using the detection method based on the actually measured value for the developing unit 31

The engine control unit 115 detects end of lifetime of the photosensitive member unit 32 using the charging current. The charging current is a current flowing between the charging device 82 and the photosensitive member 81 in a state in which the same charging bias as at the time of image formation is applied between the charging device 82 and the photosensitive member 81. The measurement of the charging current is performed at a timing required, when image formation is not being performed but during image formation. Specifically, this is carried out together with the execution of the charging adjustment for optimizing the charging bias (in particular, the peak-to-peak value of the AC component). Charging adjustment is performed, for example, immediately after power-on of the image forming apparatus 100, every predetermined number of image formation, every predetermined time elapsed, or when environmental values change.

Figure 22:
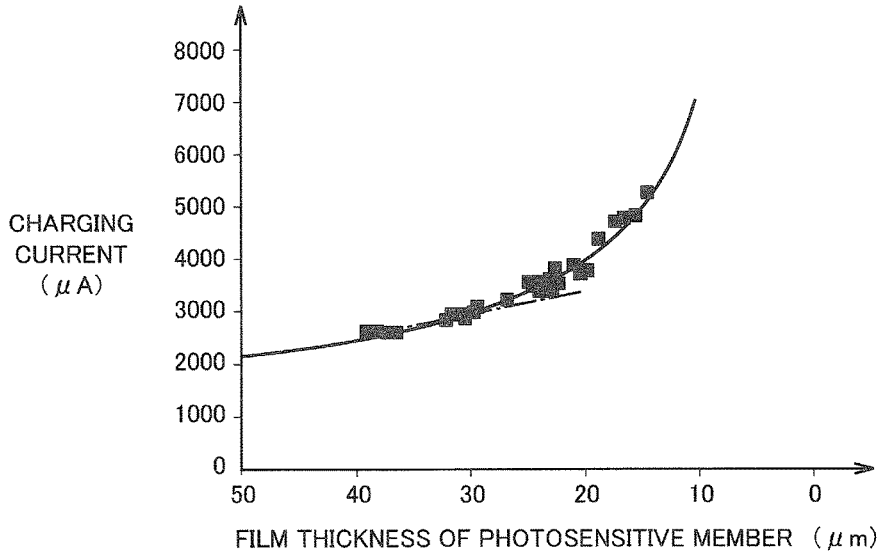
FIG. 22 is a graph showing a relationship between a charging current and a film thickness of a photosensitive member.

FIG. 22 is a graph showing the relationship between the charging current and the film thickness of the photosensitive member.

Referring to FIG. 22, the charging current is inversely proportional to the film thickness of photosensitive member 81 (more specifically, the film thickness of the photosensitive layer on the surface of photosensitive member 81). Therefore, it is possible to know the film thickness of the photosensitive member 81 from the charging current. If the film thickness is known, the decrease amount (referred to as a decrease slope) of the film thickness per rotation time of the photosensitive member 81 from the brand-new state of the photosensitive member 81 to the charging current measurement time can be calculated from the following formula (3). The initial film thickness in the formula (3) is a known value according to the specification.

$$\text{Decrease slope}=(\text{initial film thickness}-\text{current film thickness})/\text{current cumulative rotation times} \quad (3)$$

On the other hand, the film thickness of the photosensitive member 81 decreases at a constant speed as the durable use progresses. Therefore, in FIG. 22, as the durability of the photosensitive member 81 progresses, the change in the charging current with respect to the decrease of film thickness increases. This means that the accuracy of the film thickness of the photosensitive member 81 calculated from the charging current is higher, as approaching the end of durable use. For this reason, when detection of the reaching of lifetime end using the detection method based on the actually measured value for the photosensitive member unit 32, higher precision can be expected by using the newly obtained charging current value as much as possible. However, the measurement of the charging current itself has dispersion, due to environmental factors and the like. Therefore, it is not necessarily preferable to use only the latest charging current value.

Hence, the engine control unit 115 determines the decrease slope by weighting the newer charging current values, while using the charging current values obtained plural times in the past. Thus, it is possible to exclude that the influence of the measurement dispersion is excessively received, while emphasizing the newer charging current values with high accuracy.

As a premise of the present embodiment, the engine control unit 115 performs charging Vpp control at necessary timing.

Figure 23:
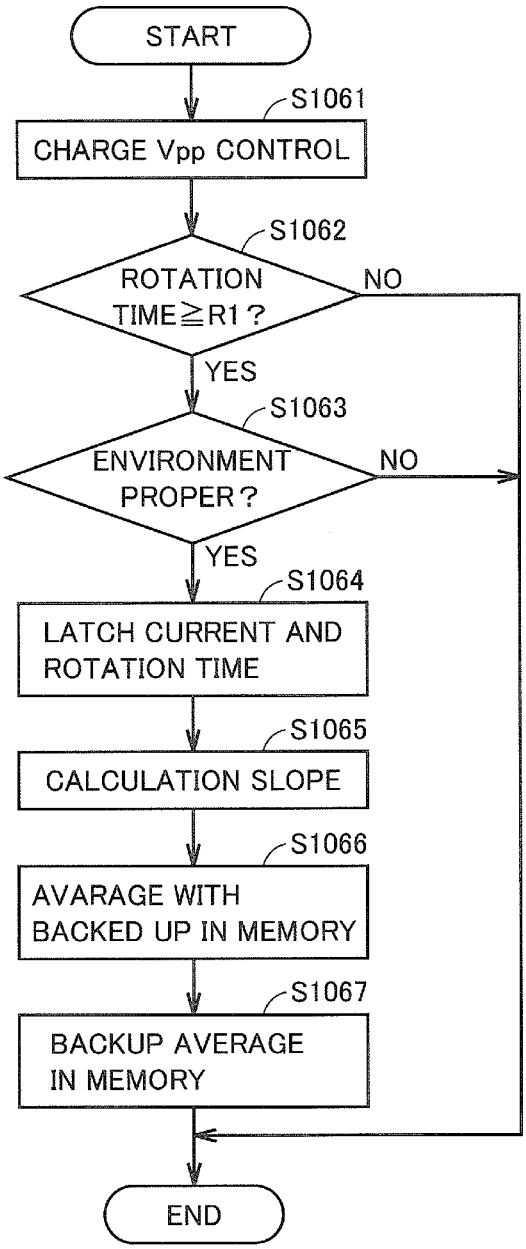
FIG. 23 is a flowchart showing charging Vpp control executed by the image forming apparatus 100, in the seventh embodiment of the present invention.

FIG. 23 is a flowchart showing the charging Vpp control executed by the image forming apparatus 100, in the seventh embodiment of the present invention.

Referring to FIG. 23, this flowchart is realized by CPU 101 executing a control program stored in ROM 102. The CPU 101 performs the charging Vpp control, that is, the charging adjustment described above and the measurement of the charging current accordingly (S1061). Since this operation itself is well known, the detailed explanation will be omitted. The determined charging biases and the measured charging current values are not necessarily the same in YMCK.

Next, the CPU 101 compares the rotation time of the photosensitive member 81 with a predetermined rotation time R1 (S1062). Here, the rotation time to be contrasted is the cumulative rotation time of the photosensitive member unit 32, at the time when the charging Vpp control of the immediately preceding S1061 is performed. The predetermined rotation time R1 is a predetermined rotation time corresponding to the area where the slope starts to rise in the graph of FIG. 22. This is shorter than the rotation time corresponding to the generally termed "life stop", that is, the rotation time which leads to the forcible stop of image formation. The predetermined rotation time R1 is also stored in the nonvolatile memory 122. It should be noted that the predetermined rotation time R1 may be different from each other in YMCK.

In step S1062, when the rotation time has not reached the predetermined rotation time R1 (NO in S1062), the CPU 101 ends the process. It is still far from the end of the life of the photosensitive member unit 32, and there is no need to precisely control the life of the photosensitive member unit 32. In addition, the gradient of the graph of FIG. 22 is still loose, and the reliability of the measured charging current value is not so high.

In step S1062, when the rotation time reaches the predetermined rotation time R1 (YES in S1062), the CPU 101 checks the environment value (S1063). More specifically, the CPU 101 checks whether or not the environment when the charging current was measured by the charging Vpp control was an ordinary calm environment. This is because the measurement result when the temperature and humidity are extreme values is inappropriate for use in determining the life.

In step S1063, if the environmental value is not appropriate (NO in S1063), the CPU 101 ends the process. This is because there is no charge current value that can be used for life determination.

In step S1063, when the environmental value is appropriate (YES in S1063), the CPU 101 latches the charging current value and the rotation time of the photosensitive member 81 (S1064). That is, the CPU 101 temporarily stores the charging current value measured in step S1061 and the cumulative rotation time of the photosensitive member 81 at that time. Subsequently, the CPU 101 calculates a decrease slope at the present time, based on the latch charge current value and the rotation time, according to the above formula (3) (S1065). Subsequently, the CPU 101 calculates the average of the decrease slope newly calculated in step S1065 and the decrease slope backed up in the nonvolatile memory 122 (S1066).

Then, the CPU 101 backs up the obtained average value as a new decrease slope in the nonvolatile memory 122 (S1067), and ends the processing. In this way, the value of the decrease slope is updated. The value of the updated decrease slope is one in which the latest charging current value is reflected by a weighting of 50%, but it is not calculated using only the latest charging current value.

Figure 24:
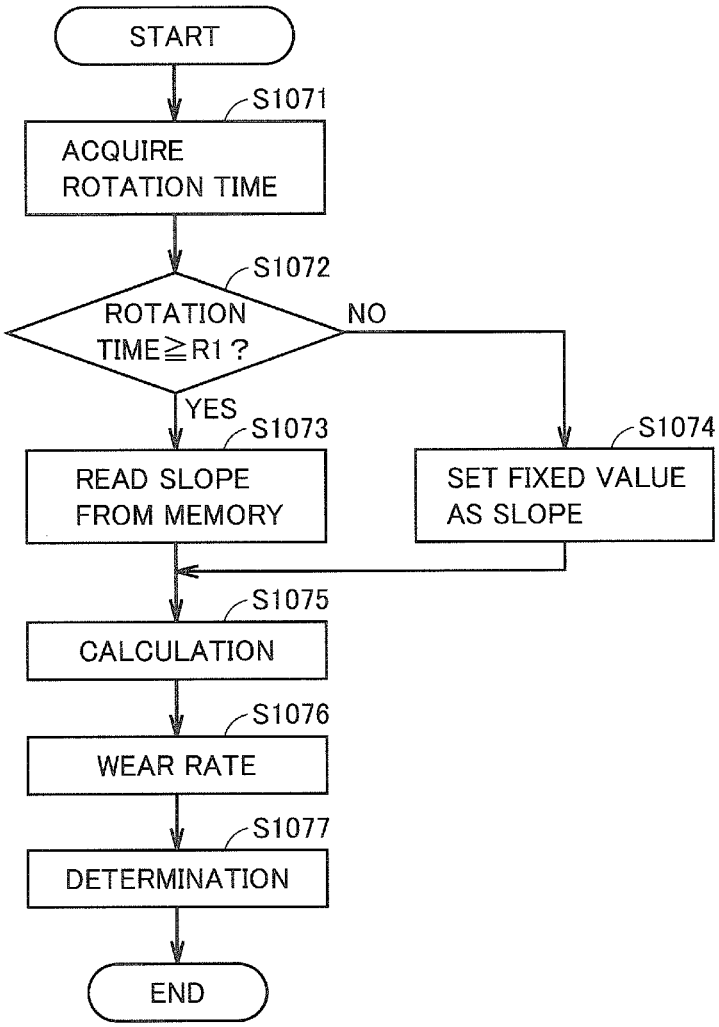
FIG. 24 is a flowchart showing a method of detecting the reaching of lifetime end using a detection method based on measured value of the photosensitive member unit 32 performed by the image forming apparatus 100, in the seventh embodiment of the present invention.

FIG. 24 is a flow chart showing a method of detecting end of lifetime using the detection method based on the measured value of the photosensitive member unit 32, executed by the image forming apparatus 100, in the seventh embodiment of the present invention.

With reference to FIG. 24, this flowchart is realized by CPU 101 executing a control program stored in ROM 102. The CPU 101 acquires the rotation time of the photosensitive member 81 from the nonvolatile memory 122 (S1071), and compares the acquired rotation time of the photosensitive member 81 with the predetermined rotation time R1 (S1072).

In step S1072, when the rotation time has reached the predetermined rotation time R1 (YES in S1072), the CPU 101 reads the value of the decrease slope of the film thickness from the nonvolatile memory 122 (S1073). The value of the decrease slope to be read out is the latest one backed up in S1067 of FIG. 23.

In step S1072, if the rotation time has not reached the predetermined rotation time R1 (NO in S1072), the CPU 101 decides not to use the value backed up in step S1067 as the decrease slope, but to use a fixed value prepared in advance (S1074). Next, the CPU 101 calculates the current film thickness of the photosensitive member 81 (S1075). That is, the CPU 101 obtains the decrease in film thickness due to execution of the image formation after the previous film thickness calculation by the decrease slope, and subtracts the decrease from the previously calculated film thickness. Then, the CPU 101 calculates the wear rate (S1076), judges whether or not the life of the photosensitive member unit 32 has been reached (S1077), and terminates the process. In step S1077, the CPU 101 compares the calculated wear rate with a predetermined limit value, an advance notice value, or the like, and makes a determination according to the comparison result.

Effect of Embodiment

According to the above-described embodiment, it is possible to properly determine the reaching of the lifetime end of the expendable item, according to the type of expendable item. In other words, expendable items that can extend their service life delay the judgment of end of lifetime as much as possible, and expendable items with a risk of extending the life judge the end of lifetime at the appropriate timing. As a result, reduction in print cost and quality assurance can be performed in a well-balanced manner. As a result, it is possible to properly judge the reaching of the lifetime end of expendable items.

According to the first embodiment, when an imitation product or a reset item is installed in the main body of the image forming apparatus, a parallel lifetime judgment method is adopted. As a result, the detection method by the counter can be compensated by the detection method based on the actually measured value. As a result, even if the performance of the expendable items deteriorates before detecting the arrival of the end of life by the detection method by the counter, it can be determined that the expendable item has reached the end of its life. It is possible to suppress deterioration in image quality due to expendable items having low performance.

According to the second embodiment, when the reused item is installed in the image forming apparatus main body, it is possible to avoid extending the unnecessary life by adopting the lifetime judgment method only by the number of times. As a result, deterioration of image quality and complication of processing due to unnecessary extension of lifetime can be suppressed.

According to the third embodiment, when the type of one expendable item in the consumable units is a genuine product and the type of another expendable item in the consumable units is a non-genuine product, it is possible to properly judge the reaching of lifetime end of the one expendable item which is a genuine product.

According to the fourth embodiment, even when the counter value becomes unusable, it is possible to properly judge end of lifetime of the genuine expendable item.

According to the fifth embodiment, when the secondhand item is installed in the main body of the image forming apparatus, a lifetime judgment method only by the actually measured value is adopted. This makes it possible to properly judge the reaching of the lifetime end of expendable items, even when a mistake in inputting a counter value or forgetting to input occurs when installing secondhand expendable items.

According to the sixth embodiment, simply by rewriting the information to be recorded in the nonvolatile memory, the lifetime of expendable items which have not been circulated to the market is not extended. It is possible to prolong the life of expendable items that can be sufficiently confirmed with achievements and performances.

According to the present embodiment, it is possible to provide an image forming apparatus and a control program of the image forming apparatus capable of appropriately determining the reaching of the lifetime end of expendable items.

Others

The above-described embodiments can be combined with each other.

The processes in the above-mentioned embodiments can be performed by software and a hardware circuit. A computer program which executes the processes in the above embodiments can be provided. The program may be provided recorded in recording media of CD-ROMs, flexible disks, hard disks, ROMs, RAMs, memory cards, or the like to users. The program is executed by a computer of a CPU or the like. The program may be downloaded to an apparatus via communication lines like the internet. The processes explained in the above flowcharts and the description are executed by a CPU in line with the program.

Although the present invention has been described and illustrated in detail, the disclosed embodiments are made for purposes of illustrated and example only and not limitation. The scope of the present invention being interpreted by terms of the appended claims.

What is claimed is:

1. An image forming apparatus comprising:

an expendable item having a specific function, installed replaceably with respect to a main body of the image forming apparatus, and a hardware processor, wherein the hardware processor:

judges end of lifetime of the expendable item by using one of a plurality of lifetime judgment methods, selects a lifetime judgment method used in the judgment, according to a type of the expendable item, detects end of lifetime of the expendable item, based on a value indicative of number of times of operation or operation time of the expendable item, in a first method, detects end of lifetime of the expendable item, based on an actually measured value relating to the expendable item, in a second method, determines end of lifetime of the expendable item, based on at least one of the detection results, detects end of lifetime of the expendable item, when the value indicative of the number of times of operation or operation time of the expendable item reaches a predetermined value, in the first method, and detects end of lifetime of the expendable item, when the actually measured value relating to the expendable item is out of a first range, in the second method, wherein the expendable item includes a nonvolatile storage device that stores a manufacturing history of the expendable item, and the type of the expendable item is specified based on the manufacturing history of the expendable item.

2. The image forming apparatus according to claim 1, wherein the hardware processor selects a parallel lifetime judgment method to detect the reaching of lifetime end by the first method and the second method simultaneously, when the type of the expendable item is an imitation product, the imitation product is a type of the expendable item that has not received quality certification from a manufacturer of the image forming apparatus, and the hardware processor judges that the life of the expendable item has been reached, when the parallel lifetime judgment method was selected, and the end of the life was detected in at least one of the first method and the second method.

3. The image forming apparatus according to claim 1, wherein the hardware processor selects an extended lifetime judgment method in which the reaching of lifetime end is detected by the first method, and after the end of lifetime is detected by the first method, the reaching of lifetime end is detected by the second method, when the type of the expendable item is a brand-new genuine product, the new genuine product is the type of an unused expendable item that has been certified for quality by the manufacturer of the image forming device, the hardware processor determines that the lifetime of the expendable item has been reached in the case where the extended lifetime judgment method is selected, and the reaching of lifetime end is detected by the second method, the hardware processor selects a lifetime judgment method only by number of times that detects end of lifetime based on the first method, when the type of the expendable item is a reused item, the reused item is a type of an expendable item that is certified for quality from the manufacturer of the image forming apparatus and is reusable by exchanging a consumed part, and the hardware processor judges that the lifetime of the expendable item has been reached, when end of lifetime is detected, in the case where the lifetime judgment method only by number of times is selected.

4. The image forming apparatus according to claim 3, further comprising:

sets of a developing unit and a photosensitive member unit of plural colors, as the expendable items, wherein the hardware processor selects the lifetime judgment method only by number of times as a lifetime judgment method for one of the expendable items in a set of the developing unit and the photosensitive member unit of a certain color, when the type of one of the expendable items in the set is the genuine product and the type of the other expendable item in the set is not the genuine product.

5. The image forming apparatus according to claim 3, wherein the hardware processor starts detecting the end of lifetime by the second method regardless of the detection result by the first method, in the case where the extended lifetime judgment method is selected, and the value indicating the number of times of operation or the operation time of the expendable item becomes unusable, during the detection of the end of lifetime by the first method, and the hardware processor judges that the life of the expendable item has been reached, when end of lifetime is detected by the second method in a case where detection of end of lifetime by said second method was started, irrespective of detection result by said first method.

6. The image forming apparatus according to claim 1, wherein the expendable item includes a nonvolatile storage device that stores a value indicative of number of times of operation or operation time of the expendable item, and the type of the expendable item is whether or not it is a reset item in which the value indicative of the number of times of operation or operation time of the expendable item stored in the nonvolatile storage device has been illegally changed.

7. The image forming apparatus according to claim 6, wherein the hardware processor selects a parallel lifetime judgment method for concurrently detecting end of lifetime according to the first method and the second method, when the type of the expendable item is the reset item, and the hardware processor judges that the life of the expendable item has been reached, in the case where the parallel lifetime judgment method is selected, and end of lifetime is detected in at least one of the first method and the second method.

8. The image forming apparatus according to claim 6, wherein the hardware processor measures an actually measured value relating to the expendable item at a predetermined timing, and determines that the type of the expendable item is the reset item, when a difference between an actually measured value relating to the expendable item measured before replacing the expendable item and an actually measured value relating to the expendable item measured after replacing the expendable item is within a second range.

9. The image forming apparatus according to claim 1, wherein the type of the expendable item is whether or not it is a secondhand item, and the secondhand item is a type of an expendable item which is not a brand-new item which has been certified as a quality from the manufacturer of the image forming apparatus and which has not reached a lifetime yet.

10. The image forming apparatus according to claim 9, wherein the hardware processor selects a lifetime judgment method only by the actually measured value that detects end of lifetime by the second method, if the type of the expendable item is the secondhand item, and the hardware processor judges that the lifetime of the expendable item has come, in the case where the lifetime judgment method only by the actually measured value is selected and the end of lifetime is detected in the second method.

11. The image forming apparatus according to claim 9, wherein the hardware processor detects installation of the expendable item on the main body of the image forming apparatus, and determines whether or not the expendable item that detected the installation is the secondhand item.

12. The image forming apparatus according to claim 1, wherein the type of the expendable item is information indicative of the lifetime judgment method, stored in the expendable item.

13. The image forming apparatus according to claim 12, wherein the hardware processor selects an extended lifetime judgment method to detect end of lifetime by the first method, and detects end of lifetime by the second method after detecting end of lifetime by the first method, if the information indicative of the lifetime judgment method stored in the expendable item is a first information, the hardware processor determines that the lifetime of the expendable item has come, in the case where the extended lifetime judgment method is selected, and end of lifetime is detected in the second method, the hardware processor selects the lifetime judgment method only by number of times to detect the end of lifetime according to the first method, if the information indicative of the lifetime judgment method stored in the expendable item is a second information different from the first information, and the hardware processor judges that the lifetime of the expendable item has come, in the case where the lifetime judgment method only by number of times is selected, and end of lifetime is detected in the first method.

14. The image forming apparatus according to claim 13, wherein the hardware processor selects a parallel lifetime judgment method for concurrently detecting end of lifetime according to the first method and the second method, if the information indicative of the lifetime judgment method stored in the expendable item is a third information different from the first and the second information, the hardware processor determines that the lifetime of the expendable item has come, in the case where the parallel lifetime judgment method is selected, and end of lifetime is detected in at least one of the first method and the second method, and rewriting of the information indicative of the lifetime judgment method stored in the expendable item is only possible to rewrite from the first information to the third information and rewrite from the second information to the third information.

15. The image forming apparatus according to claim 2, wherein the actually measured value of the expendable item is at least one of a physical property value of the expendable item and density of an image formed by using the expendable item.

16. A non-transitory computer-readable recording medium storing a controlling program for an image forming apparatus, wherein the image forming apparatus includes an expendable item having a specific function, installed replaceably with respect to a main body of the image forming apparatus, and the program causing a computer to:

judge end of lifetime of the expendable item by using one of a plurality of lifetime judgment methods, select a lifetime judgment method used in the judgment, according to a type of the expendable item, detect end of lifetime of the expendable item, based on a value indicative of number of times of operation or operation time of the expendable item, in a first method, detect end of lifetime of the expendable item, based on an actually measured value relating to the expendable item, in a second method, determine end of lifetime of the expendable item, based on at least one of the detection results, detect end of lifetime of the expendable item, when the value indicative of the number of times of operation or operation time of the expendable item reaches a predetermined value, in the first method, and detect end of lifetime of the expendable item, when the actually measured value relating to the expendable item is out of a first range, in the second method, wherein the expendable item includes a nonvolatile storage device that stores a manufacturing history of the expendable item, and the type of the expendable item is specified based on the manufacturing history of the expendable item.

17. An image forming apparatus comprising:

an expendable item having a specific function, installed replaceably with respect to a main body of the image forming apparatus, a storing unit storing a plurality of lifetime judgement methods, and a hardware processor, wherein the hardware processor determines a combination of a plurality of the lifetime judgement methods in accordance with a type of the expendable item, and judges end of lifetime of the expendable item by the combination of the plurality of the lifetime judgement methods.

18. The image forming apparatus according to claim 17, wherein the hardware processor detects end of lifetime of the expendable item, based on a value indicative of number of times of operation or operation time of the expendable item, in a first method, detects end of lifetime of the expendable item, based on an actually measured value relating to the expendable item, in a second method, and determines end of lifetime of the expendable item, based on at least one of the detection results.

19. The image forming apparatus according to claim 18, wherein the actual measured value of the expendable item is at least one of a physical property value of the expendable item and density of an image formed by using the expendable item.

* * * * *